US010767297B2

(12) United States Patent
Lin et al.

(10) Patent No.: US 10,767,297 B2
(45) Date of Patent: Sep. 8, 2020

(54) UNIDIRECTIONAL WICKING SUBSTRATE

(71) Applicant: Newtech Textile Development Company (Shanghai) Co. Ltd., Songjiang District, Shanghai (CN)

(72) Inventors: Tong Lin, Grovedale (AU); Hongxia Wang, Grovedale (AU); Hua Zhou, Grovedale (AU)

(73) Assignee: Newtech Textile Development Company (Shanghai) Co., Minhang Qu (CN)

( * ) Notice: Subject to any disclaimer, the term of this patent is extended or adjusted under 35 U.S.C. 154(b) by 65 days.

(21) Appl. No.: 15/756,772

(22) PCT Filed: Sep. 2, 2016

(86) PCT No.: PCT/AU2016/050830
§ 371 (c)(1),
(2) Date: Mar. 1, 2018

(87) PCT Pub. No.: WO2017/035599
PCT Pub. Date: Mar. 9, 2017

(65) Prior Publication Data

US 2018/0371665 A1 Dec. 27, 2018

(30) Foreign Application Priority Data

Sep. 3, 2015 (AU) ..... 2015903609

(51) Int. Cl.
*D06B 19/00* (2006.01)
*B41F 17/38* (2006.01)
(Continued)

(52) U.S. Cl.
CPC ..... *D06B 19/0005* (2013.01); *A41D 31/02* (2013.01); *B41F 17/38* (2013.01);
(Continued)

(58) Field of Classification Search
CPC .... D06B 19/0005; D06B 19/00; A41D 31/02; A41D 2500/30; A41D 2500/20;
(Continued)

(56) References Cited

U.S. PATENT DOCUMENTS 5,102,711 A 4/1992 Keller et al.
6,461,716 B1 10/2002 Lee et al.
(Continued)

FOREIGN PATENT DOCUMENTS

WO 96/33626 10/1996
WO 2013043397 3/2013

OTHER PUBLICATIONS

The International Search Report and Written Opinion dated Feb. 28, 2017, in PCT/AU2016/050830, filed Sep. 2, 2016.
(Continued)

*Primary Examiner* — Brian Handville
(74) *Attorney, Agent, or Firm* — Hovey Williams LLP

(57) ABSTRACT

The present invention provides a substrate having a unidirectional water transport property, the substrate comprised of a fluid permeable structure and including: an inner side surface; and an outer side surface having a higher absorbent capacity than the inner side surface, wherein the inner side surface has a hydrophobic surface layer extending continuously over at least one section thereof, the hydrophobic surface layer having a predetermined thickness which, in use, produces a substantial hydrophobic property to contacting water, whilst allowing for water contacting the inner side surface of the substrate to wick through the hydrophobic surface layer into the substrate; and wherein the substrate is respectively comprised of hydrophobic channels and hydrophilic channels which respectively extend between the inner side surface and the outer side surface.

11 Claims, 11 Drawing Sheets

(51) Int. Cl.

| | |
|---|---|
| ***A41D 31/02*** | (2019.01) |
| *B41F 1/00* | (2006.01) |
| *B41M 3/00* | (2006.01) |
| *D06C 23/00* | (2006.01) |
| *A41B 1/08* | (2006.01) |
| *A47G 9/02* | (2006.01) |
| *D03D 1/00* | (2006.01) |
| *D03D 13/00* | (2006.01) |

(52) U.S. Cl.
CPC ..... *D06B 19/00* (2013.01); *A41B 1/08* (2013.01); *A41B 2400/62* (2013.01); *A41D 2500/10* (2013.01); *A41D 2500/20* (2013.01); *A41D 2500/30* (2013.01); *A47G 9/0253* (2013.01); *B41F 1/00* (2013.01); *B41M 3/006* (2013.01); *D03D 1/00* (2013.01); *D03D 13/004* (2013.01); *D06C 23/00* (2013.01); *D10B 2201/02* (2013.01); *D10B 2401/021* (2013.01); *D10B 2401/022* (2013.01); *D10B 2501/04* (2013.01)

(58) Field of Classification Search
CPC ..... A41D 2500/10; D10B 2501/04; D10B 2401/022; D10B 2401/021; D10B 2201/02; D03D 13/004; D03D 1/00; A47G 9/0253; A41B 1/08; A41B 2400/62; D06C 23/00; B41F 1/00; B41F 17/38; B41M 3/006
See application file for complete search history.

(56) References Cited

U.S. PATENT DOCUMENTS

| | | | | |
|---|---|---|---|---|
| 7,008,887 | B2 | 3/2006 | Rearick et al. | |
| 2002/0064639 | A1 | 5/2002 | Rearick et al. | |
| 2006/0148356 | A1 | 7/2006 | Zhang et al. | |
| 2014/0109282 | A1* | 4/2014 | White ..... | A41D 1/00 2/69 |
| 2015/0135396 | A1 | 5/2015 | White et al. | |

OTHER PUBLICATIONS

Office Action in corresponding Chinese Application No. CN201680061572.8, dated Apr. 18, 2019 (English translation attached).

* cited by examiner

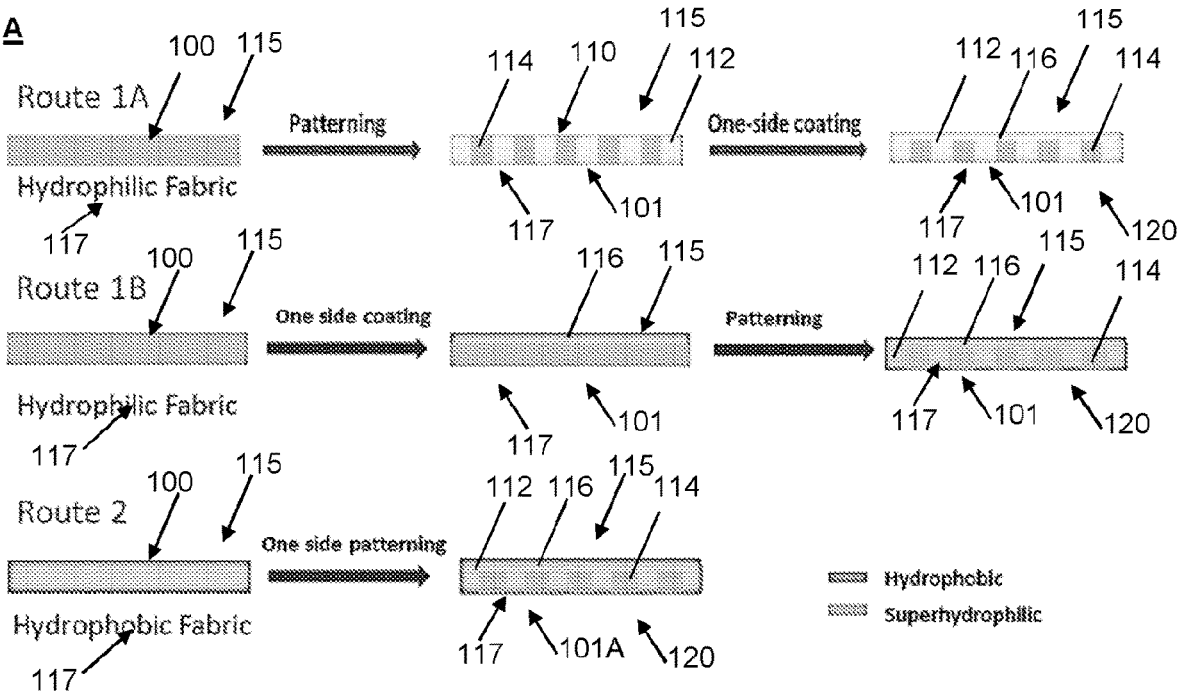
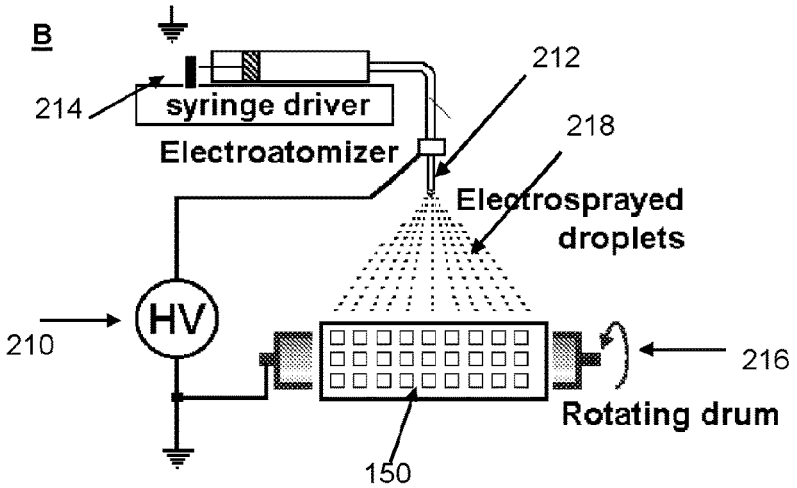
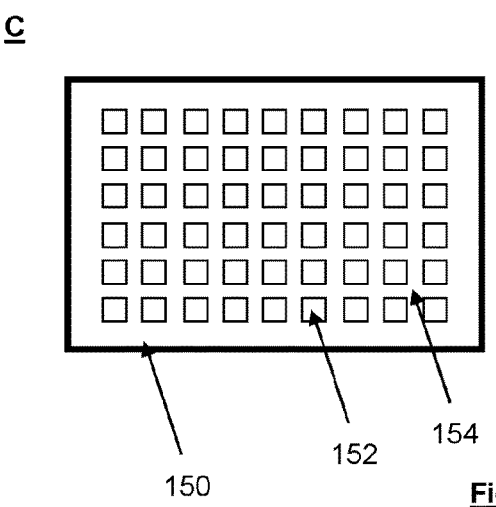
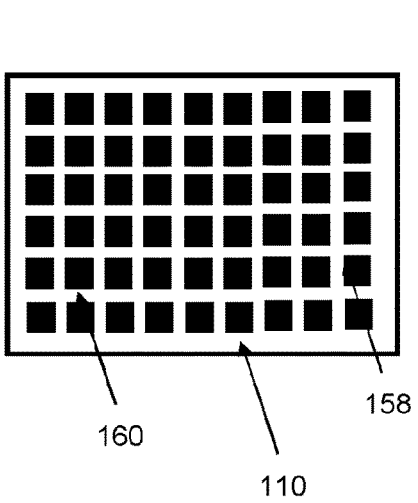
Figure 2

| ID | Texture structure | Thickness (μm) | Structure feature |
|---|---|---|---|
| No.1 | 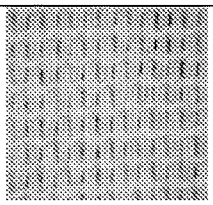 | 460 | Weaving<br>Weft double (2/2) |
| No.2 | 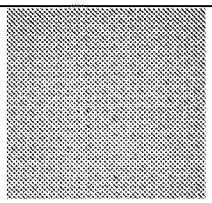 | 500 | Weaving<br>Plain weave(1/1) |
| No.4 | 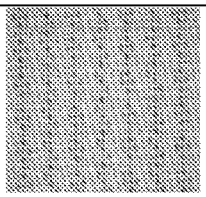 | 350 | Weaving<br>Pique weave |
| No.5 | 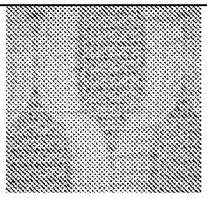 | 660 | Weaving<br>Dobby weave |
| No.6 | 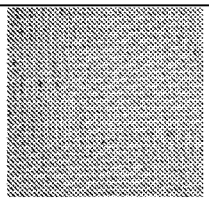 | 370 | Weaving<br>Jacquard weave |
Figure 5A

| Sample ID | Thickness (mm) | Details | Structure | Photo |
|---|---|---|---|---|
| No.1 | 0.64 | MINK denim Men's shirt | | |
| No.2 | 0.54 | SPORTSCRAFT women's SARAH OXFORD SHIRD (blue) | | |
| No.3 | 0.97 | RESERVE essentials (white) | | |
| No.4 | 0.53 | SPORTSCRAFT women's GRACE BIB SHIRT | | |
| No.5 | 0.85 | Regatta women's (aqua) | | |

| Sample ID | Thickness (mm) | Details | Structure | Photo |
|---|---|---|---|---|
| No.6 | 0.85 | RESERVE (vanilla) | | |
| No.7 | 0.90 | REGATTA essentials PETITE FIT (indigo) | | |
| No.8 | 0.48 | Target LDS CASUAL KNIT TOPS SLEEVE SHIRT (white) | | |
| No.9 | 0.36 | LIMITED EDITIONS men's business wear (white) | | |
| No.10 | 0.40 | MAISON EUROPEAN PILLOWCASE | | |

Figure 13

UNIDIRECTIONAL WICKING SUBSTRATE

CROSS-REFERENCE

The present invention application is a national stage application under 35 U.S.C. § 371 of International Patent Application No. PCT/AU2016/050830, filed Sep. 2, 2016, which claims priority from Australian Provisional Patent Application No. 2015903609 filed on 3 Sep. 2016 the contents of which are to be understood to be incorporated into this specification by this reference.

TECHNICAL FIELD

The present invention generally relates to a porous or permeable based substrate and method of producing a porous or permeable based substrate having a unidirectional liquid transport property. The invention is particularly applicable fibre based substrate such as a fabric used in garments and clothing and it will be convenient to hereinafter disclose the invention in relation to that exemplary application. However, it is to be appreciated that the invention is not limited to that application and could be used in a variety of applications where a unidirectional liquid transport property is required, for example porous membranes.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Cotton is used in clothing and apparel for comfort properties including the natural moisture regain, vapour transport and air permeability/breathability of cotton fibres. However, cotton has not been widely used in recreational performance apparel due to its high absorbency of perspiration. It is desirable for the fabric in such garments to wick or transport the moisture away from the skin to the outer side of the garment where it is dispersed by evaporation. The high absorbency of cotton can result in the garment becoming too wet and heavy; have a lengthy drying period; and sticks to the skin. This can lead to discomfort and restriction in freedom of movement of a wearer. Slow drying of a wet fabric may also allow more time for bacterial action to create undesirable odours from the absorbed perspiration.

An alternative to using cotton in recreational performance apparel is to use hydrophobic synthetic fibres in the apparel. A variety of treatment chemistries are commercially available that can be used to produce wicking of liquid moisture in normally hydrophobic thermoplastic synthetic garments. However, synthetic fibres such as polyester with wicking finishes do not provide the same level of comfort to the wearer during periods of non-exertion as cotton garments. Polyester absorbs almost no water within the fibre and tends to feel clammy when relatively low levels of liquid moisture are present, because the moisture is present on the surface of the fibres. In addition, many synthetic garments suffer from odour retention problems.

Cotton has also not been preferred in some absorbent products that are worn next to the skin. For example, cotton has not been preferred in the topsheets of adult and baby diapers and sanitary napkins. The topsheet is typically a nonwoven fabric formed from synthetic fibres. Body fluids must pass through the topsheet and into an absorbent core where it is trapped. In order to maximize the comfort of the user of such a product, it is desirable to maximize the wicking of liquid in the Z direction (i.e. the direction normal to the plane of the fabric) and away from the skin. The ideal scenario is for the topsheet to stay dry.

It would therefore be advantageous to provide products prepared from cotton or other cellulosic materials which have reduced absorbent capacity but include wicking properties.

One known form of wicking cellulosic fabric known as WICKING WINDOWS™ fabric is taught in U.S. Pat. No. 7,008,887 B2. This fabric is formed using a fabric treatment regime in which a hydrophobic pattern is printed onto the inner-surface of the treated fabric. The resulting structure comprises a woven or knit fabric having two functional sections, being:

an inner side surface treated to have a discontinuous hydrophobicity, comprising sections of yarn treated with a hydrophobic treatment and sections of yarn not treated with a hydrophobic treatment, or other methods such as a hydrophobic top sheet with punched apertures, or with embedded hydrophilic fibres which from the wicking windows; and an outer side surface having a higher absorbent capacity than the inner side surface, the fabric has channels of hydrophilic fibres from the inner side surface to the outer side surface for wicking liquid contacting the inner side surface of the fabric to the outer side surface of the fabric.

This structure produces untreated wicking windows or channels of fabric (aperture, untreated fibres or similar) in the hydrophobic layer inner side surface to the hydrophilic layer which wick any moisture from the inner side surface to the outer side surface for evaporation.

Whilst the fabric provides for effective wicking from the inner side surface to the outer side surface, the discontinuous hydrophobicity on the inner layer created by the wicking window channels can allow for two way moisture transport. Hence, although the garment surface next to the body can be up to 50% drier and less clinging than that of normal cotton fabrics, the garment can still feel wet and cling to the skin because moisture can be transported towards a user's skin from the fabric. Once the fabric becomes overly-saturated or fully-wetted the moisture content of the fabric blocks the penetration of air/moisture vapour from body side, resulting in impermeable feeling and completely losing the moisture management ability.

It would therefore be desirable to provide an alternate wicking fabric which preferably addresses one or more disadvantages of known wicking cellulosic fabrics such as wicking windows.

SUMMARY OF THE INVENTION

In a first aspect, the present invention provides a substrate having a unidirectional water transport property, the substrate comprised of a fluid permeable structure and including:

an inner side surface; and an outer side surface having a higher absorbent capacity than the inner side surface, wherein the inner side surface has a hydrophobic surface layer extending continuously over at least one section thereof, the hydrophobic surface layer having a predetermined thickness which, in use, produces a substantial hydrophobic property to contacting water, whilst allowing for water contacting the inner side surface of the substrate to wick through the hydrophobic surface layer into the substrate; and wherein the substrate is respectively comprised of hydrophobic channels and hydrophilic channels which respectively extend between the inner side surface and the outer side surface.

The present invention provides a functional substrate that has effective directional water-transport ability. The configuration of the porous or permeable substrate of the present invention significantly enhances the moisture management ability of that substrate, providing water transport from the inner side to the outer side of the substrate have irreversible directionality therethrough. In this respect, the hydrophilic channels, in use, assist in wicking liquid contacting the inner side surface of the substrate from the inner side surface to the outer side surface of the substrate. The hydrophobic channels ensure that the substrate remains permeable to air and moisture even if the hydrophilic channels are fully wetted. The fabric therefore has unidirectional water-transport ability from the inner surface to the outer surface and a sustainable permeability to air and moisture even when in an over-saturated state.

The substrate of the present invention can proactively transfer water (for example perspiration or sweat) from the inner side (or body side) of the substrate to the outer side (external surface) of the substrate, but prevent water on the external surface from wicking back to the inner side of the substrate. This effectively avoids accumulation of water on the body surface, keeping the wearer in a dry and conformable state even if they are heavily sweating.

Advantageously, the different wettability of the inner side and outer side surfaces can also generate a temperature difference between the two sides of the substrate (i.e. inner side and outer side) during moisture evaporation from the substrate, which can causes cooling of the fabric on the wettable surface (i.e. a "self-cooling" effect). The configuration of the substrate of the present invention therefore enhances the moisture management ability, self-cooling effect, and breathability of such substrates.

When the present invention is compared to other existing wicking fabrics such as Wicking Windows, one of the channels of the substrate of the present invention comprises a continuous hydrophobic surface layer, with the substrate still including a multitude of permeable non-wetting "channels" (i.e. the hydrophobic channels) across the substrate and wettable hydrophilic channels. A fabric made according to the present invention can proactively transfer sweat/moisture off the body surface, but completely eliminates the wet and clingy feeling owing to the continuous hydrophobic surface layer (i.e. "ever dry"). The non-wetting hydrophobic channels ensure the high air and moisture permeability regardless of the wet state. The novel water transport property can also induce a heat-flow from the skin side out towards the surface (i.e. "self-cooling"). These features allow the fabric proactively transfer sweat/moisture off the body surface, leaving a desirable dry microenvironment.

The substrate shows a directional water transport effect from the inner side of the substrate to the outer side. The Inventors have found that the directional water transport effect is enhanced by the hydrophobic surface layer on one side of the substrate penetrating only a small depth into the surface of that side of the substrate, thus forming a layer on the inner side of the substrate having only a small thickness. This results in a continuous coverage of the hydrophobic property on one side of the substrate which preferably penetrates no more than 150 μm in the thickness of the substrate, preferably no more than 100 μm of the substrate thickness, yet more preferably no more than 70 μm thickness of the substrate.

To maximize the air permeability of the substrate at full wetted state, the hydrophobic pattern treatment should extend a substantial depth through the thickness of the substrate, preferably more than 70% of the thickness of the substrate, more preferably more than 90% of the thickness of the substrate, even more preferably more than 99% of the thickness of the substrate, yet more preferably at 99.5% the thickness of the substrate.

Again, the directional water transport effect is enhanced by the hydrophobic surface layer on one side of the substrate penetrating only a small depth into the surface of that side of the substrate. In embodiments, the hydrophobic surface layer preferably has a thickness of between 20 to 100 μm, preferably 30 to 70 μm.

The hydrophobic channels are preferably arranged in a pattern along the length and width of the substrate to interspace the hydrophobic channels and hydrophilic channels. Any number of suitable patterns can be used. In some embodiments, the pattern could be irregular depending on the use. However, if the pattern is irregular, it should distribute to the whole functional area. In some embodiments, the pattern comprises a regular repeating pattern. For example, in some embodiments the hydrophobic channels are arranged in a regular array of spaced apart sections across the length and width of the substrate. The hydrophobic channels are preferably arranged to be respectively interspaced by the hydrophilic channels. More preferably, the hydrophilic channels surround and interspace the hydrophobic channels. In some embodiments, the hydrophobic channels form columns between the inner side surface and the outer side surface which are surrounded by the hydrophilic channels.

The ratio of hydrophobic channels to hydrophilic channels in the substrate is important in determining the breathability of the substrate in a fully wetted condition. It is preferred that the substrate has higher air permeability than the equivalent untreated substrate in a fully-wet condition. This can be achieved by having a requisite proportion of hydrophobic channels within the substrate compared to hydrophilic channels. The proportion of hydrophobic channels within the substrate compared to hydrophilic channels is preferably between 1.5:1 to 1:1.5, more preferably between 1.2:1 to 1:1.2, yet more preferably between 1.1:1 to 1:1.1, and yet more preferably about 1:1. In an alternate definition, the proportion of hydrophobic channels are arranged in a pattern which occupy between 30 to 70%, preferably between 40 and 60%, more preferably between 45 and 55%, and even more preferably about 50% of the total surface area of the lateral plane of the pattern.

In some embodiments, the hydrophobic layer and/or the columns of hydrophobic channels comprises a hydrophobic surface treatment. Any suitable hydrophobic treatment can be used to produce the hydrophobic surface layer and the hydrophobic channels in the substrate. For example the hydrophobic treatment may selected from the group consisting of polymers, small molecules, salts, coupling agents, crosslinker, organic or inorganic solids (e.g. particles) and solvents. Specific examples include silicones, fluorochemicals, polyurethane, latexes, waxes, crosslinking resins, and blends thereof. In some embodiments, the hydrophobic treatment to produce the hydrophobic surface layer and hydrophobic channels includes the application of silicones, waxes, fluorocarbons, polymer, inorganic compounds, oils, latexes, or crosslinking resins or coupling agents. Blends of these hydrophobic treatment materials may also be used. In preferred embodiments, the hydrophobic treatment comprises at least one chemical that can form a hydrophobic coating on fibres. In some embodiments, the hydrophobic channels comprise superhydrophobic surfaces.

The use of the inner side thin continuous hydrophobic surface layer in conjunction with the channel structure provides the following advantageous properties to the substrate:

- unidirectional transport of water from the inner side to outer side surface, but not in opposite direction unless an external force is applied to the substrate;
- a highly permeable structure to air and moisture in both dry and fully wetted conditions; and
- a dry feeling to user from the inner surface when the substrate is fully wetted.

In relation to the unidirectional transport of water from the inner side to outer side surface, the inner side of the substrate preferably has an accumulative one-way transport capacity index (R) (measured by AATCC Test Method 195-2011—from the outer side to the inner side of the substrate) of at least 200, preferably at least 300, and more preferably at least 400. Furthermore, the hydrophobic surface layer and hydrophobic channels preferably have a water contact angle greater than 140 degrees, preferably 150 degrees. Similarly, the un-pattern areas are hydrophilic, with contact angle of less than 30 degrees, and more preferably less than 10 degrees. Moreover, the substrate preferably has an overall moisture management capability (OMMC) value (measured by AATCC Test Method 195-2011) of ≥0.4, preferably ≥0.5.

The treatment also considerably improves the wet-state permeability of the substrate. In a fully-wet condition, the substrate preferably has higher air permeability than the equivalent untreated substrate.

As noted above, the different wettability of the inner side and outer side surfaces can generate a temperature difference between the two sides of the substrate during moisture evaporation from the substrate, which causes cooling of the substrate on the wettable surface (i.e. a "self-cooling" effect). This self-cooling effect is preferably provided by the surface temperature difference between the inner side surface and outer side surface of a fully wetted substrate being at least 2° C., preferably at least 3° C. during moisture evaporation from the substrate.

In some embodiments, particular fabric embodiments, the functional coating is also preferably durable enough against at least 50 cycles of repeated washing. In this respect, the substrate preferably retains an R value of at least 200 after at least 50 cycles of repeated washing.

The present invention also relates to a method of producing the substrate though the application of a hydrophobic or hydrophilic treatment which is selectively used to apply a through thickness treatment to produce the internal channel structure of the inventive substrate, and the thin continuous hydrophobic surface layer. The nature of the treatment depends on the nature of the starting substrate. In this respect, substrate may take a number of forms prior to treatment. For example, the substrate prior to treatment, could be a:

(1) hydrophilic substrate having a sufficient wetting properties for the hydrophilic columns of the present invention;

(2) hydrophilic substrate not having a sufficient wetting properties for the hydrophilic columns of the present invention;

(3) hydrophobic substrate; or (4) superhydrophobic substrate.

Where the substrate for treatment comprises a hydrophilic substrate, that substrate is preferably treated using a hydrophobic treatment. A second aspect of the present invention therefore provides a method of producing a unidirectional water transport property to a hydrophilic substrate, the substrate being fluid permeable and having an inner side surface; and an opposite outer side surface, the method including the steps of:

applying a hydrophobic treatment in a predetermined pattern on and through the thickness of at least a portion of the substrate, said pattern comprising hydrophobic treated channels and untreated hydrophilic channels which respectively extend between the inner side surface and the outer side surface; and applying a coating of hydrophobic treatment to the surface of the inner side of the substrate, the coating applied to produce a hydrophobic surface layer having a predetermined thickness to produce a substantial hydrophobic property to contacting water, whilst allowing for wicking water contacting the inner side surface of the substrate to wick through the coating into the substrate;

thereby producing a treated substrate that allows wicking of liquid contacting the inner side surface of the substrate from the inner side surface to the outer side surface of the substrate.

The method of this second aspect of the present invention therefore creates permeable non-wetting channels in the hydrophilic substrate by forming suitable hydrophobic patterns, preferably suitable superhydrophobic patterns, on and through the thickness of the substrate and then coats one side of the substrate with a hydrophobic coating therefore imparting the advantageous properties of the substrate discussed above in relation to the first aspect of the present invention. Applying a hydrophobic coating onto the substrate substantially prevents water from wicking into the hydrophobic coated areas, while enabling the coated substrate to still remain permeable to air and moisture.

It should be appreciated that the steps of the method of this second aspect can be undertaken in any order. Accordingly in some embodiments, the steps are carried out in the following order:

(1) applying a hydrophobic treatment in a predetermined pattern on and through the thickness of at least a portion of the substrate, said pattern comprising hydrophobic channels and channels which respectively extend between the inner side surface and the outer side surface; and (2) applying a coating of hydrophobic treatment to the surface of the inner side of the substrate, the coating applied to produce a hydrophobic surface layer having a predetermined thickness the substrate to produce a substantial hydrophobic property to contacting water, whilst allowing for wicking water contacting the inner side surface of the substrate to wick through the coating into the substrate.

However, in other embodiments, the steps are carried out in the following order (i.e. the reverse order to above):

(1) applying a coating of hydrophobic treatment to the surface of the inner side of the substrate, the coating applied to produce a hydrophobic surface layer having a predetermined thickness the substrate to produce a substantial hydrophobic property to contacting water, whilst allowing for wicking water contacting the inner side surface of the substrate to wick through the coating into the substrate; and (2) applying a hydrophobic treatment in a predetermined pattern on and through the thickness of at least a portion of the substrate, said pattern comprising hydrophobic channels and channels which respectively extend between the inner side surface and the outer side surface.

The method of the present invention differs depending on that initial nature of the substrate. For example, where the substrate is a hydrophilic substrate meeting the wetting requirement for the substrate, that substrate can simply undergo the above two step treatment method. However, where the substrate is a hydrophobic substrate or a hydrophilic substrate not meeting the wetting requirement, that substrate preferably undergoes a hydrophilic pretreatment step in which the substrate is immersed or otherwise treated with a hydrophilic treatment solution or the like, and then above two step treatment method could be undertaken.

Where the substrate is hydrophobic or superhydrophobic, an alternate method is required. A third aspect of the present invention therefore provides a method of producing a unidirectional water transport property to a hydrophobic substrate comprised, the substrate having an inner side surface; and an opposite outer side surface, the method including the steps of:

applying a hydrophilic treatment in a predetermined pattern on and through the thickness of at least a portion of the substrate, said pattern comprising:

hydrophilic channels and untreated hydrophobic channels which respectively extend between the inner side surface and the outer side surface; and a hydrophobic surface layer having a predetermined thickness to produce a substantial hydrophobic property to contacting water, whilst allowing for wicking water contacting the inner side surface of the substrate to wick through the coating into the substrate, thereby producing a treated substrate that allows wicking of liquid contacting the inner side surface of the substrate from the inner side surface to the outer side surface of the substrate.

The method of this third aspect of the present invention therefore creates permeable non-wetting channels in the substrate by forming suitable hydrophilic patterns in the substrate, (i.e. on and through the thickness of the substrate), whilst leaving a hydrophobic surface layer on the inner side of the substrate thereby imparting the advantageous properties of the substrate discussed above in relation to the first aspect of the present invention.

Again, the method of the present invention can therefore differ depending on that initial nature of the substrate. For example, where the substrate is a sufficiently hydrophobic substrate, that substrate can undergo the treatment method of the third aspect. However, where the substrate does not have sufficient hydrophobic nature or is a hydrophilic substrate (and the above third aspect method is desired to be used), that substrate can undergo a hydrophobic or superhydrophobic pretreatment step in which the substrate is immersed or otherwise treated with a hydrophobic treatment solution or the like, and then above treatment method could be undertaken.

It should also be appreciated that where it may not be possible to easily form a hydrophobic surface layer on the inner side in a single treatment step, the third method could comprise the steps of:

applying a hydrophilic treatment in a predetermined pattern on and through the thickness of at least a portion of the substrate, said pattern comprising hydrophilic channels and untreated hydrophobic channels which respectively extend between the inner side surface and the outer side surface; and applying a coating of hydrophobic treatment to the surface of the inner side of the substrate, the coating applied to produce a hydrophobic surface layer having a predetermined thickness the substrate to produce a substantial hydrophobic property to contacting water, whilst allowing for wicking water contacting the inner side surface of the substrate to wick through the coating into the substrate.

The pattern of a hydrophobic or hydrophilic treatment can be applied to part of (i.e. a portion of, or section of) or to the whole substrate. The portion treated will depend on the desired application and treatment of the substrate. For example, in some garments formed from a fabric based substrate it may be preferred to apply a unidirectional water transport property to only selected portions of that garment.

The continuous hydrophobic are preferably arranged in a pattern along the length and width of the substrate to interspace the hydrophobic channels and hydrophilic channels. Any number and shape of suitable patterns can be used. In some embodiments, the hydrophobic channels are arranged in a regular array of spaced apart sections across the length and width of the substrate. It should be appreciated the patterns described above for the first aspect of the invention equally apply to both the second and third aspects of the present invention.

A number of application techniques can be used to apply the pattern of a hydrophobic treatment, the coating of hydrophobic treatment in the two-step coating and the hydrophilic treatment. The pattern of a hydrophobic or hydrophilic treatment is preferably applied using at least one of electrospraying, ink jet printing, screen printing, stamp printing, block printing, roller printing, heat transfer printing, photographic printing, discharge printing, duplex printing, transfer printing, plasma treatment or a combination thereof. Similarly, the coating of hydrophobic treatment to the surface of the inner side of the substrate is preferably applied using at least one of electrospraying, ink jet printing, roller printing, screening printing, transfer printing, discharge printing, duplex printing, plasma treatment or a combination thereof.

In one embodiment, an electrostatic spraying technique or electrospraying process is employed to apply the hydrophobic coating onto the inner side of the substrate. This technique advantageously allows for control the depth of coating penetration into the substrate. In some embodiments, an electrospraying process is used to achieve the two method steps (the pattern of a hydrophobic treatment and the coating of hydrophobic treatment to the surface of the inner side of the substrate). Both steps can preferably use the same coating materials.

In exemplary embodiments, the pattern of hydrophobic treatment (second aspect) or pattern of hydrophilic treatment (third aspect) is applied to the substrate using a combination of electrospraying and screen printing using a screen having the desired aperture patterned formed therein. The patterned screen can have any desired configuration of apertures and shapes of apertures for applying the hydrophobic or hydrophilic pattern. In some embodiments the shaped apertures are preferably polygon or circular. In one preferred form the apertures are substantially square in shape. However, any shape could be used, for example stars, custom shapes such as logos or the like.

The permeability in wet state can actually be controlled through adjusting the portion of hydrophobic channels. In order to provide a suitable ratio of hydrophobic channels to hydrophilic channels in the substrate, the apertures of the screen preferably form between 30 to 70% of the surface area of the screen, preferably between 40 and 60%, more preferably between 45 and 55%, and even more preferably about 50%. The proportion of hydrophobic channels within the substrate compared to hydrophilic channels is therefore preferably between 1.5:1 to 1:1.5, more preferably between 1.2:1 to 1:1.2, yet more preferably between 1.1:1 to 1:1.1, and yet more preferably about 1:1.

The hydrophobic or hydrophilic treatment is preferably dried after application, particularly where that treatment is a solution or suspension. This process is mainly decided by the particular treatment used. The method of the present invention can therefore further include the step of drying the treated substrate after the application of the hydrophobic treatment to the substrate. Any suitable drying regime can be used to dry the hydrophobic or hydrophilic treatment. For example, in one embodiment treated substrate is dried at between 50 and 180° C., preferably 120 to 150° C. for between 10 to 30 mins, preferably 15 minutes.

The selection of the hydrophobic treatment used in the method of this second aspect can be very flexible. Any suitable hydrophobic treatment can be used to produce the hydrophobic surface layer and the hydrophobic channels in the substrate. For example the hydrophobic treatment may selected from the group consisting of polymers, small molecules, salts, coupling agents, crosslinker, organic or inorganic solids (e.g. particles) and solvents. Specific examples of the hydrophobic treatment may selected from the group consisting of silicones, fluorochemicals, polyurethane oils, latexes, waxes, crosslinking resins, and blends thereof In some embodiments, the hydrophobic treatment to produce the hydrophobic surface layer and hydrophobic treated channels includes the application of silicones, waxes, fluorocarbons, zirconium compounds, oils, latexes, or crosslinking resins or agents including carboxylic acids and polycarboxylic acids such as citric, maleic, butane tetra carboxylic, or polymaleic acids. Blends of these hydrophobic treatment materials may also be used. In preferred embodiments, the hydrophobic treatment comprises at least one fluorocarbon, preferably polytetrafluoroethylene (PTFE). In some embodiments, the hydrophobic treatment comprises a superhydrophobic treatment.

In some embodiments, a single coating material can be used for both patterning and one side coating. Moreover, the hydrophobic treatment can be applied by any suitable means and in any suitable form. In a preferred embodiment the hydrophobic treatment is applied as a solution or suspension to the substrate.

Similarly, the selection of the hydrophilic treatment used in the method of the third aspect can be very flexible. Any suitable hydrophilic treatment can be used to produce the hydrophilic treated channels in the substrate. Hydrophilic treatment includes low surface energy chemical treatment, preferably polymer. For example the hydrophilic treatment may selected from the group consisting of polymers, small molecules which bring hydrophilic groups such as carboxyl, sulfonic acid, hydroxyl, carbonyl, amino, sulfhyfryl, phosphate or quaternary ammonium groups, or hydrophilic links such as ether, ester, aminde, imide, phosphodiester, glycolytic and peptide, in the molecule backbone. Example includes, polyalcohol, polysugar, polyaldehydes, polyketones, polycarboxylic acids, amino acid, polyamine, polythiols, nucleic acids and phospholipids, polyethers, disaccharides, polysaccharides, peptide, polypeptides, proteins, collagen, gelatine, etc. Crosslinker, surfactant, or coupling agent could be present in the coating to enhance the coating durability.

It should be appreciated that additional components can optionally be added to the substrate (e.g. fibre, yarn, fabric, membrane and/or garment) compositions of the present invention. These include, but are not limited to, fire retardants, dyes, wrinkle resist agents, foaming agents, buffers, pH stabilizers, fixing agents, softeners, optical brighteners, emulsifiers, antibacterial agent, UV shielding, thermos-conductive material, thermo-insulator, and surfactants.

It is to be understood that the method of the second or third aspect of the present invention could be used to form a substrate according to the first aspect of the present invention. Accordingly it should be understood any features described above for the substrate of the first aspect of the present invention could be used and applied to the method of the second or third aspect of the present invention and vice versa.

A fourth aspect of the present invention provides a substrate having a unidirectional water transport property formed by a method according to the second aspect of the present invention.

The hydrophobic columns and hydrophilic columns in the substrate can have any suitable configuration. In most embodiments, the columns comprise zones or discrete sections in the substrate which have a hydrophobic or hydrophilic property. For example, in some embodiments the columns comprise columns of material (fibres or pores or the like) having the respective hydrophobic or hydrophilic property. In some embodiments, the comprise columns of surfaces of the material comprising the substrate (fibres or pores or the like) having the respective hydrophobic or hydrophilic property. As described above, the hydrophobic or hydrophilic property of the columns may be a result of a treatment regime or could be inherent in the material of the substrate in that particular column.

The substrate of the various aspects of the present invention can be formed from a variety of materials and compositions.

In some embodiments, the substrate comprises a plurality of fibres, for example a fabric. The substrate can be comprised of all types of fibres, including hydrophilic, hydrophobic and their blends. In some embodiments, the substrate may comprises fibers (and yarn formed therefrom where applicable) selected from natural fibers, synthetic fibers or a blends thereof.

In some embodiments, the substrate is comprised from cellulosic fibres, preferably cotton fibres or a cotton blend fibres. In exemplary embodiments, the present invention relates to cellulosic substrates with reduced absorbent capacity having the capability to wick liquids, as well as to methods of manufacturing such cellulosic substrates. The invention also relates to methods for reducing the absorbent capacity of cellulosic fibres, yarns, fabrics, garments, and other articles having cellulosic fibres.

In embodiments, the substrate of the present invention comprises a fabric. The fabric can comprise any suitable type of fabric including woven fabrics, knit fabrics, nonwoven fabrics, multilayer fabrics or the like. Fabrics with these features can significantly strengthen comfort feature to the wearers, especially when they are perspiring heavily. It is also useful for reducing the chance for the wearers getting heat stress in high temperature environment through the development of advanced summer clothing to reduce dangers in high temperature environments.

The substrate of the present invention can comprise any suitable form of fabric. For example, the fabric could comprise at least one of an unwoven, woven or knitted fabric.

The fabric can be formed from one or more yarns. The yarns can have the same composition or a different composition. The yarn or yarns are used to form a fabric that has an inner side surface and an outer side surface. The fabric is formed (see for example the method of the second aspect of the present invention) such that the inner side surface has a substantially lower absorbent capacity than the outer side surface due to the hydrophobic coating and such that the resulting fabric is capable of wicking liquid from the inner side surface of the fabric to the outer side surface of the fabric. The fabric can be formed by any suitable method, including carding, air lay, wet lay, hydroentangling, thermal bonding, chemical bonding, needle punching, or combinations thereof.

It should be appreciated that the substrate of the present invention is not limited to garment of fabric applications. For example, in some embodiments the substrate comprises a membrane, for example functional membranes for filtration. In some embodiments, the membrane comprises a porous membrane. The porous membrane may not consist of any fibres.

The porous membranes, preferably thin porous membranes according from the present invention comprise an open pore structure throughout the membrane. The pores preferably form a three dimensional open pore structure throughout the membrane. This ensures that the membrane is fluid permeable. A number of membranes are suitable, including those made by any of the foam forming technique such as phase separation, freeze dry, single- or two-direction stretching, gas foaming, using of porogen, particle fusing, or etching, etc. Examples of suitable membranes includes two-direction stretched PP or PTFE membranes, gas foaming polyurethane membrane, and polymer membrane prepared by phase separation methods.

In those embodiments where the substrate is comprises of a plurality of fibres, the present invention can comprise the following aspects:

In embodiments, the present invention provides a substrate having a unidirectional water transport property, the substrate comprised of plurality of fibres and including:

an inner side surface; and an outer side surface having a higher absorbent capacity than the inner side surface;

wherein the inner side surface has a hydrophobic surface layer extending continuously over at least one section thereof, the hydrophobic layer having a predetermined thickness which, in use, produces a substantial hydrophobic property to contacting water, whilst allowing for water contacting the inner side surface of the substrate to wick through the hydrophobic layer into the substrate; and wherein the substrate is respectively comprised of continuous channels of hydrophobic fibres and channels of hydrophilic fibres which respectively extend between the inner side surface and the outer side surface.

Where the substrate for treatment comprises a hydrophilic substrate, that substrate is preferably treated using a hydrophobic treatment. A second aspect of the present invention therefore provides a method of producing a unidirectional water transport property to substrate comprised of a plurality of hydrophilic fibres, the substrate having an inner side surface; and an opposite outer side surface, the method including the steps of:

applying a hydrophobic treatment in a predetermined pattern on and through the thickness of at least a portion of the substrate, said pattern comprising continuous channels of hydrophobic treated fibres and channels of untreated hydrophilic fibres which respectively extend between the inner side surface and the outer side surface; and applying a coating of hydrophobic treatment to the surface of the inner side of the substrate, the coating applied to produce a hydrophobic layer having a predetermined thickness the substrate to produce a substantial hydrophobic property to contacting water, whilst allowing for wicking water contacting the inner side surface of the substrate to wick through the coating into the substrate;

thereby producing a treated substrate that allows wicking of liquid contacting the inner side surface of the fabric from the inner side surface to the outer side surface of the fabric.

Where the substrate is hydrophobic or superhydrophobic, an alternate method is required. A third aspect of the present invention therefore provides a method of producing a unidirectional water transport property to substrate comprised of a plurality of hydrophobic fibres, the substrate having an inner side surface; and an opposite outer side surface, the method including the steps of:

applying a hydrophilic treatment in a predetermined pattern on and through the thickness of at least a portion of the substrate, said pattern comprising:

continuous channels of hydrophilic treated fibres and channels of untreated hydrophobic fibres which respectively extend between the inner side surface and the outer side surface; and a hydrophobic layer having a predetermined thickness the substrate to produce a substantial hydrophobic property to contacting water, whilst allowing for wicking water contacting the inner side surface of the substrate to wick through the coating into the substrate, thereby producing a treated substrate that allows wicking of liquid contacting the inner side surface of the fabric from the inner side surface to the outer side surface of the fabric.

The substrate of the present invention has application in a number of environments, particularly in garments such as sportswear, socks, gloves, workwear and uniforms. The substrate of the present invention also has application in filtration (functional membranes), bedding products, and medical fabrics such as bandages, and collecting and storage of fresh water (e.g. rain water).

BRIEF DESCRIPTION OF THE DRAWINGS

The present invention will now be described with reference to the figures of the accompanying drawings, which illustrate particular preferred embodiments of the present invention, wherein:

FIG. 2 provides (A) three schematics of the different treatment procedures according to the process of embodiments of the present invention; (B) a general schematic of the electrospray process used to apply the hydrophobic treatment coating in each stage; (C) an example screen for the first coating step; and (D) the resulting patterned sheet substrate from the first coating step.

FIGS. 4*a* and 4*b* is the un-washed fabric, and 4*c* and 4*d* are the treated fabric after 50 wash cycles.

FIG. 5A provides a table showing the commercial cotton samples and properties selected for coating treatment in Example 1.

FIG. 13 provides a table showing the commercial cotton samples selected for coating treatment in Example 2.

DEFINITIONS

Figure 1:
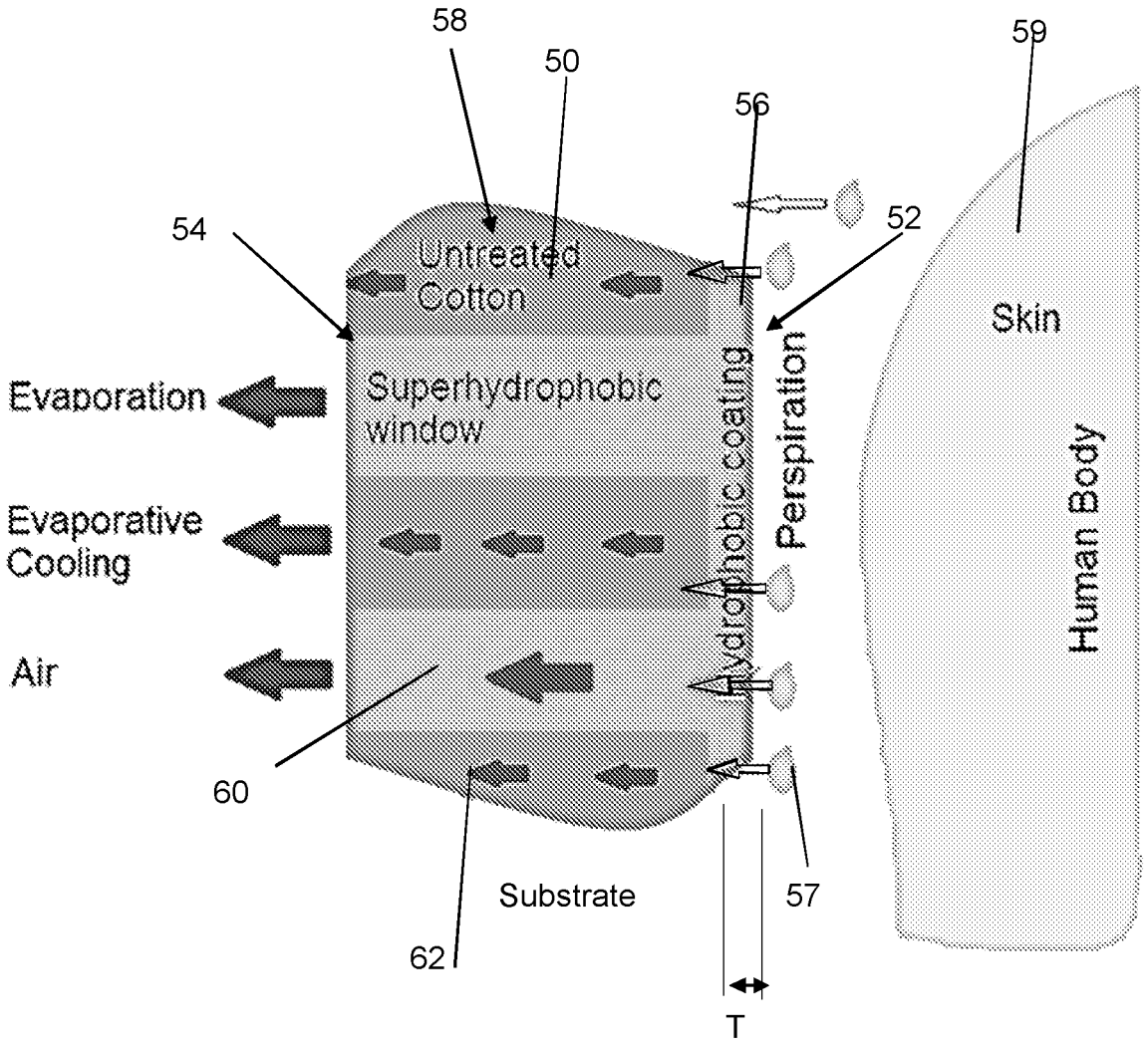
FIG. 1 provides a schematic drawing of the structure of a fibre substrate according to one embodiment of the present invention.

The following definitions are used herein:

The term "fabric" includes woven fabrics, knit fabrics, nonwoven fabrics, multilayer fabrics, and the like.

The term "cellulosic substrate" as used herein refers to substrates that include cellulosic fibres such as cotton, jute, flax, hemp, ramie, lyocell, regenerated unsubstituted wood celluloses such as rayon, blends thereof, and blends with other fibrous materials (such as, for example, synthetic fibres) in which at least about 25 percent, preferably at least about 40 percent of the fibres are cellulosic materials. The cellulosic fibres preferably comprise cotton fibres. The cellulosic substrate may include non-cellulosic fibres (such as synthetic fibres and non-cellulosic natural fibres) including, for example, a polyolefin such as polypropylene or polyethylene, polyester, nylon, polyvinyl, polyurethane, acetate, mineral fibres, silk, wool, polylactic acid (FLA), or polytrimethyl terephthalate (PTT), and may include mixtures thereof. In addition, the cellulosic substrate may consist entirely of cellulosic fibres such as cotton. The substrate may be any article that contains cellulosic fibres in the requisite amount, and includes, for example, woven fabrics, knit fabrics, nonwoven fabrics, multilayer fabrics, garments, yarns, absorbent products, topsheets of absorbent products, and the like.

The substrates of the present invention include substrates having an "inner side" and an "outer side." The "inner side" of such substrates comprises at least an inner side surface of the substrate and may include all or a portion of the interior of the substrate. The "outer side" of such substrates comprises at least an outer side surface of the substrate and may include all or a portion of the interior of the substrate. Generally, the inner side surface of such substrates contacts a user's skin while in use.

The terms "gross absorbency" and "absorbent capacity" are used interchangeably herein to mean the mass of liquid (e.g., perspiration, water, urine, menstrual fluid, etc.) which is picked up or contained in a fibre, fabric, garment, or other substrate which is exposed to the liquid under conditions of use. In other words, the absorbent capacity is the total amount of liquid moisture which a fibre, fabric, garment, or other substrate will pick up or hold when in contact with excess liquid moisture from a wet surface such as skin. More specifically, absorbent capacity is the mass of liquid per unit mass of fibre, fabric, garment, or other substrate at saturation.

The term "reduced absorbent capacity" as used herein means that the absorbent capacity of the fibre, fabric, substrate, cellulosic substrate, or other article is lower than the normal, standard, or regular absorbent capacity of the fibre, fabric, substrate, cellulosic substrate, or other article. The term "reduced absorbent capacity" describes fibre, fabric, substrate, cellulosic substrates, or other articles whose absorbent capacity has been reduced or lowered by methods described herein to below the normal, standard, or regular absorbent capacity of the fibre, fabric, substrate, cellulosic substrate, or other article.

DETAILED DESCRIPTION

The present invention generally provides a porous and/or fluid permeable substrate having two functional features: 1) unidirectional transport of water from one side to another, but not in opposite way unless an extra force is applied; and 2) high permeability to air and moisture in both dry and fully wetted conditions. These properties impart a noticeable difference in breakthrough pressure and one-way water transport ability on the two sides of the substrate. The functionalised substrates have significantly higher moisture transport ability and better wear comfort performance than the normal substrate, for example cotton fabric, of the same fibre structure (but without the inventive hydrophobic and hydrophilic pattern).

A schematic of the functionalise pattern or structure of one substrate 50 of the present invention is shown in FIG. 1 which provides a side cross-sectional view (through the thickness of the substrate) to illustrate the internal structure of this substrate 50. As shown in FIG. 1, the substrate is formed in two broad or general layers between an inner side surface 52 and an outer side surface 54. These two layers 56, 58 are as follows:

1. A thin continuous hydrophobic coating or layer 56 extending from the inner side surface 52 having a predetermined thickness. The hydrophobic nature of this layer 56 produces a substantial hydrophobic property to contacting water, whilst allowing for wicking water (for example perspiration 57 from a human body 59) contacting the inner side surface 52 of the substrate 50 to wick through the layer 56 into the substrate 50; and
2. A pattern or array 58 of hydrophobic channels 60, interspaced by hydrophilic channels 62, each of which extend between the inner side surface 52 and the outer side surface 54 in the body of the substrate 50. The hydrophilic channels 62 allow for wicking liquid (for example perspiration 57 from a human body 59) contacting the inner side surface of the substrate 50 from the inner side surface 52 to the outer side surface 52 of the substrate 50.

As shown in FIG. 1, the illustrated functionalise substrate 50 can proactively transfer water (for example perspiration or sweat 57) from the inner side surface 52 to the outer side surface 54, where that water can evaporate. The functionalise substrate 50 also prevents water on the outer side surface 54 from wicking back to the inner side surface 52. This effectively avoids accumulation of water on the body surface 59, keeping the wearer in a dry and conformable state even if they are heavily sweating. The hydrophobic channels 60 through the substrate 50 also ensure that the substrate 50 remains permeable to air and moisture even if the hydrophilic channels 62 are fully wetted. This structure also causes an evaporative cooling effect within the substrate 100, with the different wettability of the inner side and outer side surfaces generate a temperature difference between the two fabric sides during moisture evaporation from the fabric, which can causes cooling of the fabric on the wettable surface (i.e. a "self-cooling" effect).

As shown in FIG. 1, the hydrophobic channels 60 are arranged in a pattern, typically a regular pattern along the length and width of the substrate to interspace the hydrophobic channels and hydrophilic channels. The hydrophobic channels 60 form columns between the inner side surface 52 and the outer side surface 54 which are surrounded by the hydrophilic channels 62. The ratio of hydrophobic channels 60 to hydrophilic channels 62 in the substrate is important in determining the breathability of the substrate 100 in a fully wetted condition. The proportion of hydrophobic channels 60 within the substrate 100 compared to hydrophilic channels 62 are usually between 1.5:1 to 1:1.5. Preferably, the ratio is about 1:1.

The invention also provides method of producing the substrate though the application of a hydrophobic or hydrophilic treatment which is selectively used to apply a through thickness treatment of superhydrophobic finish to produce the internal hydrophobic/hydrophilic channel structure of the substrate, and the thin continuous hydrophobic surface layer. The nature of the treatment depends on the nature of the starting substrate. In this respect, substrate may take a number of forms prior to treatment, including:

(1) hydrophilic substrate having a sufficient wetting properties for the hydrophilic columns of the present invention;
(2) hydrophilic substrate not having a sufficient wetting properties for the hydrophilic columns of the present invention;
(3) hydrophobic substrate; or
(4) superhydrophobic substrate.

Where the substrate for treatment comprises a hydrophilic substrate, that substrate is preferably treated using a hydrophobic treatment. Thus, where the substrate comprises a hydrophilic material, the method includes the steps of:

applying a hydrophobic treatment in a predetermined pattern on and through the thickness of at least a portion of the substrate, said pattern comprising hydrophobic channels and untreated hydrophilic channels which respectively extend between the inner side surface and the outer side surface; and applying a coating of hydrophobic treatment to the surface of the inner side of the substrate, the coating applied to produce a hydrophobic surface layer having a predetermined thickness the substrate to produce a substantial hydrophobic property to contacting water, whilst allowing for wicking water contacting the inner side surface of the substrate to wick through the coating into the substrate.

It should be appreciated that the steps of this method can be undertaken in any order. Furthermore, where the hydrophilic substrate does not have a sufficient wetting property or is a hydrophobic substrate, the substrate can undergo a hydrophilic treatment using a suitable hydrophilic treatment to provide a substrate having suitable hydrophilic properties.

Where the substrate is hydrophobic or superhydrophobic, i.e. the substrate is comprised of hydrophobic material, the method includes the steps of:

applying a hydrophilic treatment in a predetermined pattern on and through the thickness of at least a portion of the substrate, said pattern comprising:

continuous hydrophilic channels and untreated hydrophobic channels which respectively extend between the inner side surface and the outer side surface; and a hydrophobic surface layer having a predetermined thickness the substrate to produce a substantial hydrophobic property to contacting water, whilst allowing for wicking water contacting the inner side surface of the substrate to wick through the coating into the substrate.

As can be appreciated, this pattern could be achieved in one step, with the channels and hydrophobic surface layer being produced in a single treatment step that was accurate enough so that the hydrophilic treatment did not penetrate fully through the thickness of the substrate. In other embodiments, two steps could be used where a hydrophilic treatment is used to form the column structure of hydrophobic and hydrophilic fibre channels (as described above) and then a hydrophobic treatment could be applied to form the thin hydrophobic surface layer.

In some embodiments, a hydrophobic substrate can be pre-treated to have a superhydrophobic surface on both the inner and outer sides, and then hydrophilic treat to have semi-penetration wetting channels (as above) to create directional water transport effect.

In a specific example, a two-step coating process was developed to functionalize cotton fabric in accordance with the present invention. FIG. 2 provides a schematic of the two stages of the treatment procedure of the present invention in three different scenarios.

Firstly, FIG. 2A shows the general steps of this process for a hydrophilic substrate (route 1A and 1B) and a hydrophobic substrate (route 2). The treatments steps for route 1 A are as follows:

STEP ONE: a non-wetting or hydrophobic pattern 101 is applied to and on a substrate 100, for example a superhydrophilic fabric such as cotton, by applying a pattern of hydrophobic treatment solution using a suitable printing or liquid patterning method to form a patterned substrate 110. The pattern 101 comprises a through thickness treatment (i.e. treatment which penetrates through the thickness of the substrate 100) of the hydrophobic treatment solution which forms discrete sections or channels of hydrophobic treated fibres 112 surrounded by sections or channels of untreated hydrophilic fibres 114, each section 112, 114 extending through the thickness of the substrate 100; and STEP TWO: a hydrophobic treatment solution is then subsequently applied on one side 115 only (the inner side of the substrate) of the as-prepared patterned substrate 110 to produce a thin hydrophobic coating 116 thereon. The hydrophobic coating 116 is applied to that side 115 to extend substantially on that one side 115, leaving the pattern 101 from the first step extending through a substantial amount of the body of the substrate 100. The hydrophobic coating 116 is also applied with a predetermined thickness T (see FIG. 1)

which, in use, produces a substantial hydrophobic property to contacting water, whilst allowing for water contacting the inner side surface of the substrate 100 to wick through the coating 116 into the body of the substrate 100, and more specifically the untreated hydrophilic channels 114.

The coated substrate 120 is then allowed to dry, preferably in a heated environment. It should be appreciated that the drying process is related to the treatment and substrate used.

In route 1B, the steps above are performed in the opposite order with STEP TWO being performed first followed by STEP ONE. These steps are:

STEP ONE: a hydrophobic treatment solution is applied on one side 115 only (the inner side of the substrate) of the as-prepared patterned substrate 110 to produce a thin hydrophobic coating 116 thereon. The hydrophobic coating 116 is also applied with a predetermined thickness T (see FIG. 1).

STEP TWO: a non-wetting or hydrophobic pattern 101 is subsequently applied to and on a substrate 100, by applying a pattern of hydrophobic treatment solution using a suitable printing or liquid patterning method. The pattern 101 comprises a thickness treatment (i.e. treatment which penetrates through the thickness of the substrate 100) of the hydrophobic treatment solution which forms discrete sections or channels of hydrophobic treated fibres 112 surrounded by sections or channels of untreated hydrophilic fibres 114.

In route 2, a hydrophobic substance is treated. This is a one step process comprising the following step:

STEP ONE: a non-wetting or hydrophilic pattern 101A is applied to and on a substrate 100, by applying a pattern of hydrophilic treatment solution using a suitable printing or liquid patterning method to form a patterned substrate 110. The pattern 101A comprises a controlled thickness treatment (i.e. treatment which does not penetrates through the thickness of the substrate 100) of the hydrophilic treatment solution which forms discrete hydrophilic sections or channels 114 surrounded by hydrophobic sections or channels 112, with an untreated hydrophobic 116 surface layer on the inner side 115.

As described above in relation to FIG. 2, the hydrophobic channels 112 are applied in a pattern along the length and width of the substrate to interspace the hydrophobic channels 112 and hydrophilic channels 114. Whilst any number of suitable patterns can be used, the hydrophobic channels 112 are typically arranged in a regular array of spaced apart sections across the length and width of the substrate 100.

After the treatment (either one of routes 1A, 1B or 2 in FIG. 2A), the hydrophobic surface layer side (designated the inner side 115 of the substrate 100) shows a directional water transport effect. The Inventors have found that the directional water transport effect is enhanced by the hydrophobic surface layer on one side of the substrate penetrating only a small depth into the surface of that side of the substrate, thus forming coating layer on the inner side of the substrate have only a small thickness. This results in a continuous coverage of the hydrophobic functionality on one side of the substrate which preferably penetrates no more than 20% of the thickness of the substrate, preferably no more than 10% of the thickness of the substrate, yet more preferably no more than 5% of the thickness of the substrate. The corollary to this is that the pattern treatment should extends a substantial depth/amount through the thickness of the substrate, preferably more than 50% of the thickness of the substrate, more preferably more than 80% of the thickness of the substrate, even more preferably more than 90% of the thickness of the substrate, yet more preferably more than 95% the thickness of the substrate. In embodiments, the hydrophobic surface layer preferably has a thickness of between 20 to 100 μm, preferably 30 to 70 μm.

A number of different techniques can be used to apply the hydrophobic treatment solution to the substrate. Application techniques electrospraying, ink jet printing, screen printing, stamp printing, block printing, roller printing, heat transfer printing, photographic printing, discharge printing, duplex printing, transfer printing or a combination thereof.

In one embodiment, the hydrophobic treatment solution is applied onto the substrate through an inkjet printing technique. In such a method a continuous inkjet printer (not illustrated) uses a high-pressure pump to direct the hydrophobic treatment solution from a reservoir through a gun-body and a nozzle to create a continuous stream of ink droplets. The ink droplets are subjected to an electrostatic field to be directed (deflected) by electrostatic deflection means to print on the substrate, or allowed to continue on undeflected to a collection gutter for re-use. Controlled positioning of the nozzle and deflection of the droplets allows for a desired pattern of to be applied to the substrate hydrophobic treatment solution in both steps of the method. For example, in step 1, the ink jet printer is controlled to apply the desired pattern of hydrophobic treatment solution to the substrate to create the columns of treated and untreated fibres through the thickness of the substrate. In step 1, the ink jet printer can be controlled to apply a thin continuous coating of the substrate to one side of the patterned substrate. The printed substrate is then allowed to dry.

In another embodiment, the hydrophobic treatment solution is applied onto the substrate through electrospraying. Electrospraying was chosen for the technique ability to quickly apply a thin coat with accuracy over a large area of a substrate. Furthermore, electrospraying has is reasonably easy to operate, and in conjunction with a patterned screen, can be used to form various patterns (both negative and positive) on cotton fabrics, with a good resolution, typically having a minimum line width of 1.5 mm. In relation to FIG. 2, the method steps are as follows:

STEP ONE: a non-wetting pattern (area portion is 50%) was generated on a fabric 100, in the illustrated case a hydrophilic fabric such as cotton, by firstly covering a selected portion of the cotton fabric 100 with a pattern apertured screen 150 and then electrospraying the hydrophobic treatment solution as electrosprayed droplets 218 onto the screen covered fabric. As shown in FIG. 2*c*, the screen 150 can comprise a sheet (typically a polymer sheet or film, though other materials can be used) of material having a regular pattern of square apertures 152 formed in the sheet. When placed over the fabric 100, the apertures 152 provide the areas of fabric 100 to which the hydrophobic treatment solution can penetrate. The fabric areas masked by the solid framework 154 of the screen 150 do not receive the hydrophobic treatment solution and therefore remain untreated. Enough hydrophobic treatment solution is applied as electrosprayed droplets 218 to the screened fabric 100 to penetrate the thickness of the material (i.e. between the inner side and outer side of the fabric). As shown in FIG. 2D, a patterned fabric 110 is formed having a regular pattern of treatment squares 158 surrounded and bounded by untreated fabric 160.

STEP TWO: The hydrophobic treatment solution is subsequently electrosprayed onto the surface of only one side 115 of the patterned fabric 110 to form a coating 116 of hydrophobic material across that side surface 115. The solution is sprayed to form a thin coating on that side surface 115. That side surface 115 is to be used as the inner side of the fabric 100 which contacts the skin or a user or wearer.

After the coating treatment, the fabrics were dried in a heated environment, for example at 70° C. for 10 to 30 minutes.

A general schematic of one type of electrospray process used to apply the hydrophobic treatment coating in each stage is shown in FIG. 2B. The electrospraying set up generally consists of a high voltage DC power supply 210 which is connected between, a nozzle 212 with a syringe container 214, and a rotating drum collector 216. An air pump (not illustrated) can also be used. The application of voltage between the needle nozzle 212 and drum collector 216 caused droplets fed from syringe container 214 to be accelerated onto the substrate held on the rotating drum collector 216. In the first step, the substrate 100 is mounted onto the drum collector 216, and then the screen 150 was placed over the substrate 100. The hydrophobic treatment solution was then loaded into the syringe container 214. The drum collector 216 is then rotated by an electric motor (not illustrated). By charging the nozzle 212 with a high voltage, the coating solution 154 was atomized and deposited evenly onto the applied surface of the substrate 100 on the drum collector 216. The coating solution can only spray through the apertures 152 of the screen 150, thus partially coating the substrate 100 in a pattern dictated by the pattern of the apertures 153 of the screen. In the second step, the screen 150 is removed to allow the hydrophobic treatment solution to coat the entire side surface of the substrate 100 attached to the drum collector 216.

As shown in FIGS. 1 and 2A, the application of the hydrophobic treatment solution in this manner to a hydrophilic substrate such as a cotton fabric provides a comb like structure 310 of hydrophobic treatment to extend through the thickness of the substrate 100. The comb like structure in cross-section comprises continuous coating 116 of hydrophobic treatment, with columns or fingers of hydrophobic functionality extending through the thickness of the substrate 100 between the inner side 115 and outer side 117 thereof. The continuous coating 116 of hydrophobic treatment on the inner side 115 attached makes the un-patterned area 114 of the substrate 100 remain hydrophilic have a directional water transport effect (unidirectional from inner side to outer side, resisting transport from outer side to inner side). It is noted that the substrate 100 can also be functionalized in the reverse way.

The substrate of the present invention is treated have a hydrophobic inner side surface and a pattern of hydrophobic channels that extend between the inner side and outer side of the substrate. There are a variety of commercially available hydrophobic chemical treatments to impart hydrophobic and/or superhydrophobic properties to a substrate. The chemical treatments are referred to herein as "hydrophobic treatments" and include application of any material or materials (referred to herein as a "hydrophobic treatment chemical") that are capable of introducing hydrophobicity into the substrate (for example a fibre, yarn, fabric, garment, membrane or other substrate). Where the substrate comprises a fibre based substrate, the chemical treatments may be done on the fibre or yarn. However, in the present invention, it is preferred that the fabric, or the completed cellulosic substrate (e.g., garment) or other article is subjected to the method of treatment of the present invention described above.

Any suitable hydrophobic treatment can be used to produce the hydrophobic coating and the hydrophobic channels in the substrate. In some embodiments, the hydrophobic treatment to produce the hydrophobic coating and hydrophobic channels includes the application of silicones, waxes, fluorocarbons, polyurethane, oils, latexes, or crosslinking resins or agents including carboxylic acids and polycarboxylic acids such as citric, maleic, butane tetra carboxylic, or polymaleic acids. Blends of these hydrophobic treatment materials may also be used. In preferred embodiments, the hydrophobic treatment comprises at least one fluorocarbon, preferably polytetrafluoroethylene (PTFE). The hydrophobic treatment forming the hydrophobic coating or layer and hydrophobic channels are discussed in more detail below.

Hydrophobic treatments of the present invention include application of a hydrophobic treatment material such as, for example, silicones, fluorochemicals, zirconium compounds, oils, latexes, waxes and a variety of others including crosslinking resins such as dimethylol dihydroxy ethylene urea (DMDHEU), urea formaldehyde, ethylene urea, melamine resins, dimethyl urea glyoxal (DMUG), carboxylic acids and polycarboxylic acids including citric, maleic, butane tetra carboxylic, polymaleic acids, and many others. Blends of these and other hydrophobic treatment materials may also be used.

An exemplary example of hydrophobic treatment material include application of fluorocarbons (e.g., ZONYL® brand, Teflon® brand, Repearl® brand, Nuva® brand, etc.) that do not adversely affect cotton's beneficial properties, for example, the comfort properties during "normal" wearing when the wearer and the garment are in the dry state without significant perspiration. Polytetrafluoroethylene (PTFE) is a specific example of one exemplary fluorocarbon. Fluorocarbons impart a superhydrophobic property to the fibre, yarn, fabric, or other substrate it is applied, providing exemplary hydrophobic properties to the applied portions of the fabric. One exemplary hydrophobic treatment material comprises ZONYL321 available from the DuPont Company.

For fibre based and/or fabric substrates, these hydrophobic treatments (e.g., fluorocarbons and silicones) can be applied to a fibre such as cotton without reducing the natural moisture regain, natural moisture vapour transport or the natural breathability of cotton fabrics and garments. Therefore, when performance garments are made as described in these examples, the basic comfort properties of cotton that are present during "normal" (dry) wearing of regular (untreated) cotton garments will also be present in garments containing treated fibre, yarn or fabric.

Whilst not wishing to be limited by any one theory, hydrophobic treatments such as application of fluorocarbons, silicones, and waxes are generally thought to function by forming a film on the outer side of the fibres. At normal application levels this film is highly discontinuous, to the extent of being closer to microscopic "globs" of polymer or wax on the surface of the hydrophilic fibres. The treatments do produce hydrophobic fibres, fabrics and yarns from those which were previously hydrophilic because the surface tension of water or perspiration generally does not allow the penetration of liquid into the fibres and reduces wicking in the capillaries formed between treated fibres or yarns. Thus, in the context of the present invention, whilst the hydrophobic coating on the inner side of the substrate has hydrophobic properties from this coating material, the surface still retains a porous structure between fibres due to the highly discontinuous nature of the film on those fibres. This porous structure still allows wicking in the capillaries formed between treated fibres or yarns.

Whilst the above methods relate to the treatment of hydrophilic substrates, it should be appreciated that the techniques described could be equally applied to hydrophobic substrates—i.e. comprised of hydrophobic fibres, with the pattern applied with a hydrophilic treatment as opposed to a hydrophobic treatment. The selection of the hydrophilic treatment used in the method of the third aspect can be very flexible. Any suitable hydrophilic treatment can be used to produce the hydrophilic treated fibres in the substrate. For example the hydrophilic treatment includes low surface energy chemical treatment, preferably polymer. For example the hydrophilic treatment may selected from the group consisting of polymers, small molecules which bring hydrophilic groups such as carboxyl, sulfonic acid, hydroxyl, carbonyl, amino, sulfhyfryl, phosphate or quaternary ammonium groups, or hydrophilic links such as ether, ester, aminde, imide, phosphodiester, glycolytic and peptide, in the molecule backbone. Example includes, polyalcohol, polysugar, polyaldehydes, polyketones, polycarboxylic acids, amino acid, polyamine, polythiols, nucleic acids and phospholipids, polyethers, disaccharides, polysaccharides, peptide, polypeptides, proteins, collagen, gelatine, etc. Crosslinker, surfactant, or coupling agent could be present in the coating to enhance the coating durability.

It should be appreciated that additional components can optionally be added to the fibre, yarn, fabric and/or garment compositions described herein. These include, but are not limited to, fire retardants, dyes, wrinkle resist agents, foaming agents, buffers, pH stabilizers, fixing agents, stain repellents such as fluorocarbons, soil repellents, wetting agents, softeners, water repellents, stain release agents, optical brighteners, emulsifiers, and surfactants.

The fibres comprising the substrate of the various aspects of the present invention can have a variety of compositions. For example, the substrate may comprises fibers (and yarn formed therefrom where applicable) Natural fibres, synthetic fibres, or their blends. Examples include (but should not be limited to) cellulosic fibers, polymeric fibers or a blend thereof.

In some embodiments, the substrate is comprised from cellulosic fibres, preferably cotton fibres or a cotton blend fibres. In exemplary embodiments, the present invention relates to cellulosic substrates with reduced absorbent capacity having the capability to wick liquids, as well as to methods of manufacturing such cellulosic substrates. The invention also relates to methods for reducing the absorbent capacity of cellulosic fibres, yarns, fabrics, garments, and other articles having cellulosic fibres. The technique is suitable for processing various cotton fabrics, hydrophilic synthetic fabrics and thin porous membranes.

Where the substrate comprises a fabric, those fabrics are especially useful for development of sportswear, bedding products, medical fabrics for healthcare, and next-to-skin clothing in soldiers' uniform garments.

Furthermore, it should be appreciated that the present invention can have applications to products other than fabrics and garments.

In some embodiments, the fibre based substrate of the present invention may comprise at least one part of an absorbent product such as diapers and sanitary napkins.

Generally, diapers and sanitary napkins include a topsheet that is worn next to the user's skin and an absorbent core that is used to store bodily fluids such as urine and menstrual fluid. The topsheet has an inner side surface for contacting the users skin and an outer side surface. The absorbent core is adjacent the outer side surface of the topsheet. The absorbent core may be formed from any absorbent material such as, for example, hydrophilic fibres (such as cellulosic fibres), superabsorbent polymers, and mixtures thereof. As used herein, the absorbent core includes any acquisition layer between the final storage area (for bodily fluids) of the absorbent product and the topsheet.

The topsheet is typically a nonwoven and may have a predominantly hydrophobic inner side (i.e., a topsheet that has a reduced absorbent capacity) and an outer side that is predominantly absorbent. The topsheet may also be uniformly and predominantly hydrophobic from inner side to outer side, as long as it is designed to allow fluid to pass quickly through the topsheet and into the absorbent core. The fibre based substrate of the present invention could therefore be used as a topsheet in such products.

The composition of the top sheet could comprise any suitable fibre combination treated to impart the structure of the present invention. These include (1) 100% cellulosic fibres; (2) a blend of cellulosic fibres and synthetic fibres such as polypropylene, polyester, or nylon; (3) a blend of cellulosic fibres which have been treated with a hydrophobic treatment and a synthetic fibre which has wicking properties; and (4) a blend of absorbent cotton (or other hydrophilic fibre) and cotton (or other hydrophilic fibre) which has been treated or processed to be hydrophobic. Cotton linters, comber, gin motes, shoddy, and various other lower cost cotton waste materials may be used as the source of cotton.

The functionalise substrate of the present invention can also be used in membrane applications. In such applications, a suitable base substrate such as a yarn based fabric (knitted, woven, non-woven or the like), short fibre sheet, or other fibre based sheet can be treated to provide the functionalise structure of the present invention as shown in FIG. 1. Such a sheet provided ideal properties for membrane applications as the membrane sheet provides for unidirectional transport of water whilst still being highly permeable to air and moisture in both dry and fully wetted conditions. Applications include (but should not be limited to) filtration, water storage, collection of rain water, tent, outdoor fabric, and wound healing bandage, moisture keep face membrane for cosmetology, water absorbing garment.

In some embodiments, the substrate could include single layer fibrous material and porous membrane (thickness less than 5 mm, preferably less than 1 mm). Thin porous membranes according from the present invention comprise an open pore structure throughout the membrane. The pores preferably form a three dimensional open pore structure throughout the membrane. This ensures that the membrane is fluid permeable. A number of membranes are suitable, including those made by any of the foam forming technique such as phase separation, freeze dry, single- or two-direction stretching, gas foaming, using of porogen, particle fusing, or etching, etc. Examples of suitable membranes includes two-direction stretched PP or PTFE membranes, gas foaming polyurethane membrane, and polymer membrane prepared by phase separation methods.

It should be appreciated that porous membranes having the unidirectional properties of the present invention are formed using the same methods described above and exemplified for fabric (fibre based substrates). It should be understood that the above treatment methods which use hydrophobic and/or hydrophilic treatments can equally be used for porous membranes.

Methods of Evaluating the Compositions

The suitability of the treatment compositions for an intended use will depend on the ability of the treated cellulosic substrate to pass various standard performance tests. Some examples of suitable performance tests are present in the Examples below, while others are known to those skilled in the art of manufacture of the type of end products and methods taught and noted above.

EXAMPLES

Example 1—Development of Durable Superhydrophobic Pattern Treated Cotton Fabrics Durable superhydrophobic treated cotton fabrics were developed having both directional water transport effect and breathable superhydrophobic pattern through further coating superhydrophobic solution on one side of the as-prepared non-wetting pattern cotton fabric using electrospraying coating technique.

Whilst the examples use a commercially available superhydrophobic coating material (ZONYL 321, a fluorocarbon surfactant manufactured by DuPont Company), it should be appreciated that a large variety of hydrophobic and/or superhydrophobic coating material could equally be used in the same pattern and coating techniques to achieve the directional water transport effect and breathable superhydrophobic pattern demonstrated in the exemplified examples. A number of suitable coating treatments are described above, and it should be appreciated that these could be utilised in similar techniques described in these examples.

2. Experimental Details 2.1 Materials:

A commercial coating material for superhydrophobic cotton fabric treatment ZONYL 321 (fluorocarbon surfactant) manufactured by DuPont Company. ZONYL 321 is a fluorinated acrylic cationic copolymer which can be used for hydrophobic coating treatment of substrate.

Cotton fabrics were purchased from a Melbourne supermarket. Five cotton fabrics with different textures were chosen, being Fabric ID No. 1, No. 2, No. 4, No. 5, and No. 6 shown in FIG. 5A.

Cotton fabrics ID: No. 1, plain weave, thickness 460 μm is exemplified in this example.

2.2 Preparation of the Superhydrophobic Coating Solution:

ZONYL321 solution was prepared by mixing ZONYL321 (10 g) in deionized water (100 ml) to form a homogenous solution.

2.3 Non-Wetting Pattern Treatment on Cotton Fabrics:

A two-step coating process was developed to functionalize cotton fabric in accordance with the present invention. The general schematic of this process has been described above and is provided in FIG. 2.

Figure 3:
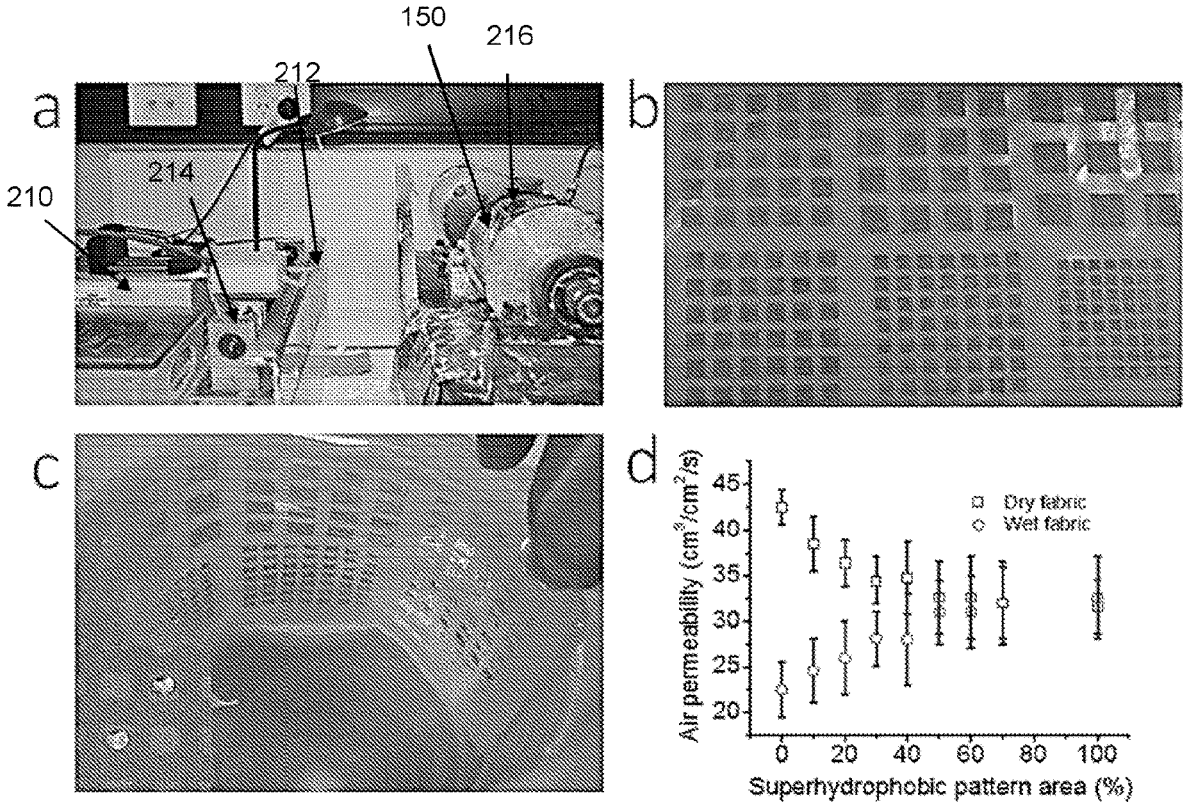
FIG. 3 shows a) a photograph of the e-spraying equipment used to apply the superhydrophobic pattern and coating to the cotton substrates, b) a photograph of the resulting screen-printing film, c) a photograph of the non-wetting pattern treated cotton fabric immersed in water, the insert picture shows two water droplets stayed on pattern area, d) a plot showing the effect of different superhydrophobic pattern area on air permeability of the treated non-wetting pattern fabrics.

For this particular example, a combination of screen-printing with electrospraying was employed to apply the ZONYL321 coating solution. The cotton sample comprises a cotton fabric swatch of 10×10 $cm^2$ having a plain weave (weft double 2/2), and thickness of 460 μm (Cotton fabrics ID: No. 1, FIG. 5A). The following steps were taken to treat that fabric:

STEP ONE: a non-wetting pattern (area portion is 50%) was generated on cotton fabric by firstly covering a selected portion of the cotton fabric with a pattern apertured screen 150 and then electrospraying the coating solution (ZONYL321) onto the screen 150. As shown in FIGS. 2*c* and 3*b*, the screen comprised a sheet (polymer film) of material having a regular pattern of square apertures formed in the sheet. As FIG. 3*b* shows, a variety of aperture sizes were used in the screen 150. When placed over the fabric, the apertures provide the areas of fabric to which the coating solution can penetrate. When the coating solution is applied, the coating solution can pass through the apertures of the pattern areas, and be blocked on the solid film of the un-pattern areas. The fabric areas masked by the solid framework of the screen do not receive the coating solution and therefore remain untreated. Enough coating solution is applied to the screened fabric to penetrate the thickness of the material (i.e. between the inner side and outer side of the fabric). As shown in FIG. 3*c*, a patterned fabric is formed having a regular pattern of treatment squares surrounded and bounded by untreated fabric.

STEP TWO: The coating solution (ZONYL321) is subsequently electrosprayed onto the surface of only one side of the patterned fabric to form a coating of hydrophobic material across that side surface. The solution is sprayed to form a thin coating on that side surface having a 50 μm depth. That side surface is to be used as the inner side of the fabric which contacts the skin or a user or wearer.

After the coating treatment, the fabrics were dried at 70° C. for 15 minutes.

FIG. 3*a* shows the actual experimental electrospraying setup used, which consists of a purpose-built setup comprising a high voltage DC power supply 210, a needle nozzle 212 with a syringe container 214, and drum collector 216 and an air pump. During coating, the fabric sample was mounted onto the drum collector 216, and then screen (sprinting film−70 mesh saran film+polyester screen) 150 was covered on the fabric sample, the coating solution was loaded to the container 114. By charging the nozzle 212 with a high voltage, the coating solution was atomized and deposited evenly onto the film surface. The coating solution can only spray through the pattern areas, resulting in the fabric sample being coated partially. Removal of the screen 150 allows the exposed side to be subsequently fully coated by the coating solution.

FIG. 3*c* shows the non-wetting pattern treated fabric. When immersing the fabric in water, there are air bubbles on the surface of superhydrophobic areas, and the un-pattern area was fully wetted, due to the hydrophilic nature. The insert picture shows when dropping water on the pattern area, a sphere like water droplets are formed. The water contact angle of the patterned area was measured to be 156°, indicating that after the coating treatment, the pattern areas turned superhydrophobic.

2.5 Washing Durability Test:

Washing durability was examined by using a standard washing procedure specified in Australian Standard (AS2001.1.4). Each wash cycles is equivalent to five cycles of home laundries. For convenience, we used the equivalent number of home machine laundries.

2.6 Liquid Moisture Management Test:

Liquid moisture management property was measured according to the test standard (AATCC Test Method 195-2011) on M290—MMT Moisture management tester. Fabric samples (size 8 cm×8 cm) were placed in a conditioned environment (temperature 21±2° C., RH 65±2%) for over 24 hours before testing. 0.9% NaCl was used as test solution.

2.7 Other Characterisations:

Water contact angle (CA) was measured on a contact angle goniometer (KSV CAM 101) using liquid droplets of 5 μL in volume. Fabric thickness was measured using a fabric thickness tester under the loading weight of 1 N. The colour difference of the fabrics was measured by Datacolor SF 600 Plus-CT Spectraflash spectrophotometer.

3. Results and Analyses 3.1 Non-Wetting Pattern Treatment on Cotton Fabric

By using the screen electro-spraying technique developed, various non-wetting patterns on cotton fabrics were prepared and examined to determine how pattern profile (e.g. shapes, density, and size) and pattern areal portion affected the air permeability of the fabrics as shown in FIG. 3*d*.

When the pattern areal portion was kept the same, pattern profile showed little effect on fabric air permeability. Using positive and negative squares as models, we systematically examined how pattern areal portion affected air permeability. At dry state, when the pattern portion increased from 0 to 50%, the air permeability showed a linear decrease from 42 to 33 $cm^3/cm^2/s$. Further increasing the areal portion from 50% to 100% led to a small decrease in the air permeability to 31.5 $cm^3/cm^2/s$. At fully-wetted state, the cotton fabric without non-wetting pattern showed a considerable decrease in air-permeability (to 22 $cm^3/cm^2/s$ from 42 $cm^3/cm^2/s$ at dry state). The presence of non-wetting pattern increased the air permeability. When the pattern portion changed from 0 to 50%, the air-permeability of the fully-wetted fabric sample increased from 22 to 31 $cm^3/cm^2/s$. When the pattern portion further increased from 50% to 100%, the air-permeability had a little change. We finally chosen the pattern portion of 50% as the optimal pattern portion because fabric at such a patterning condition showed small difference in air permeability between dry (33 $cm^3/cm^2/s$) and fully-wetted state (32 $cm^3/cm^2/s$).

3.2 Washing Test

Figure 4:
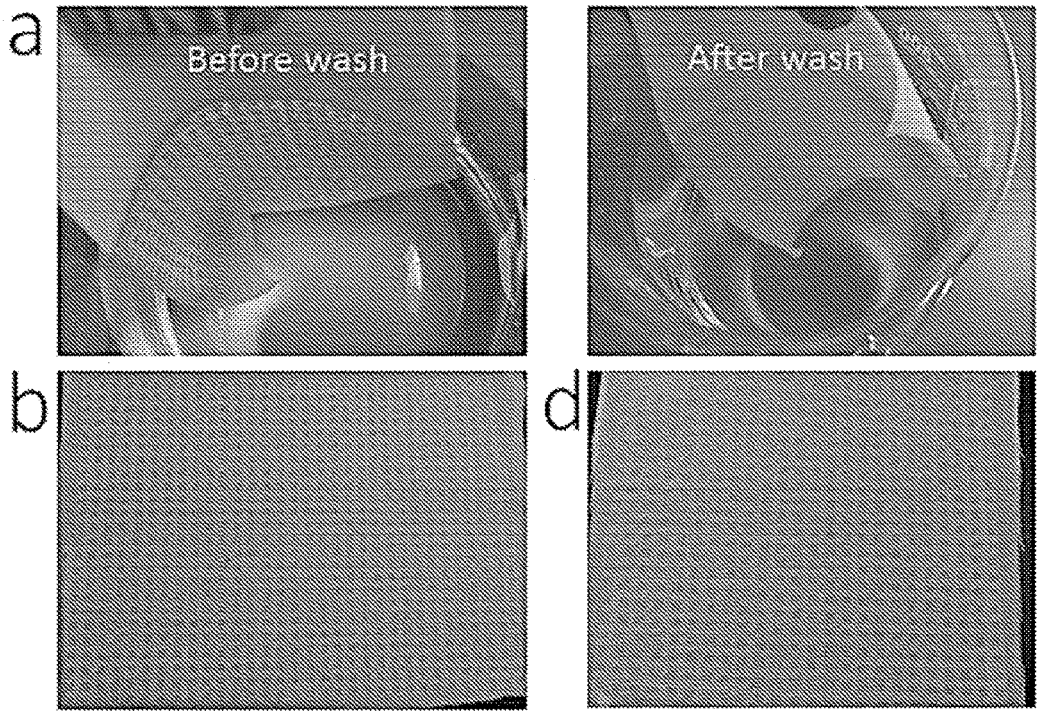
FIG. 4 provides a series of photographs showing the non-wetting pattern treated cotton fabric with 50% portion area before and after 50 cycles of repeated washing.

Washing durability of the non-wetting pattern cotton fabrics was tested using a standard washing procedure specified in Australian Standard (AS2001.1.4). After 50 cycles of washing test, there is no obvious change on air permeability, and the pattern areas are still superhydrophobic with water CA of 155°. FIG. 4 show the non-wetting pattern treated cotton fabric with 50% portion area before and after 50 cycles of repeated washing. FIGS. 4*a* and 4*b* is the un-washed fabric, and 4*c* and 4*d* are the treated fabric after 50 wash cycles.

3.3 Abrasion Test

The abrasion test was performed according to the Martindale method, a load pressure of 9 kPa was employed. After 5000 abrasion cycles, the air permeability had an increase from 33 $cm^3/cm^2/s$ to 36 $cm^3/cm^2/s$ for a dry pattern fabric, and for the fully-wetted state, the air permeability had just a slight increase from 31 $cm^3/cm^2/s$ to 32 $cm^3/cm^2/s$.

3.4 Non-Wetting Patterned Cotton Fabric with Directional Water Transport Effect

FIG. 6*a* shows positive and negative patterned cotton fabrics with directional water transport effect. FIG. 6*b* shows a series of still frames taken from a video during dropping water on the surface of the patterned cotton fabric with directional water transport effect. When water was dropped on the non-wetting e-sprayed side (two-step coated surface), it moved through and spread on the opposite side within a short time. When water was dropped on the screen patterned side (without further non-wetting e-spraying treatment), however, it spread over the surface without penetration through the fabric. The pattern area can be seen clearly from either side of the wetted fabric. These clearly indicate that the treated fabric shows both pattern and directional water transport effect.

3.5 Air Permeability

Figure 7:
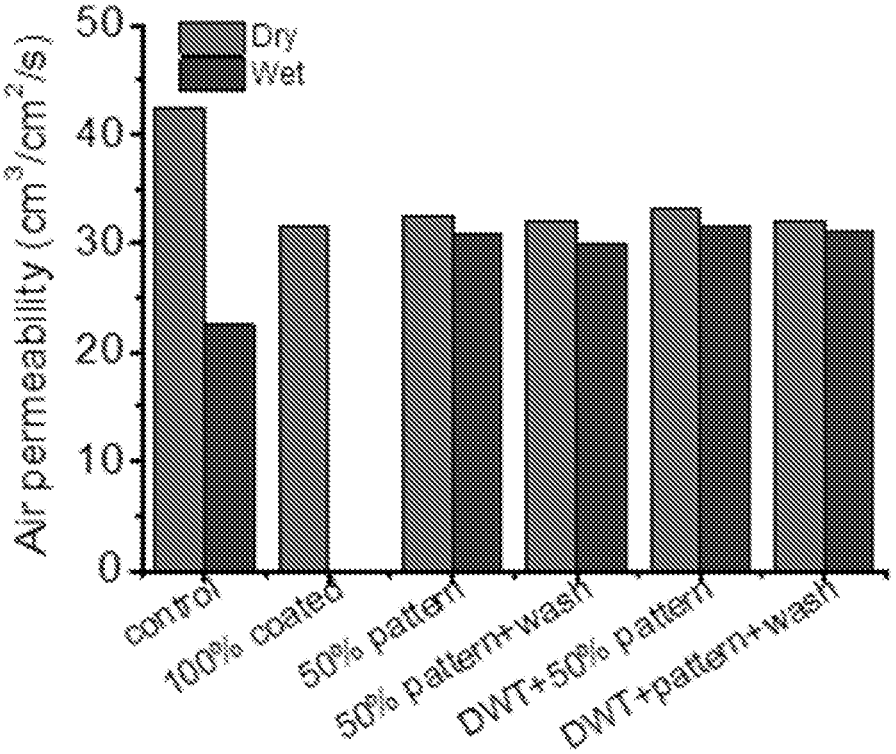
FIG. 7 is a plot demonstrating air permeability change of the cotton fabric functioned with non-wetting pattern and directional water transport effect.

The air permeability changes of the treated cotton fabric have been studied as shown in FIG. 7. For the un-treated fabric, there is a big difference of air permeability for the dry and fully-wetted state fabric, they are 42.5 $cm^3/cm^2/s$ and 22.5 $cm^3/cm^2/s$ respectively. After non-wetting pattern treatment (50% portion area), the air permeability for dry fabric decreased. However, for the fully-wetted fabric, the air permeability increased because the pattern area cannot be wetted. The air permeability is almost not change after 50 cycles of repeated washing, which indicated that the coating layer is bonded on the fibres surface firmly, and cannot be washed away. After one side e-spraying non-wetting coating treatment, the air permeability had just little bit change, which means that this thin layer coating on one side of patterned fabric did not influence the fabric's air permeability. The non-wetting pattern and directional water transport functioned cotton fabric is also washable, after 50 cycles washing tests, the air permeability is still almost same with before as seen in FIG. 7.

3.6 One Way Transport Capability

One way water transport ability was evaluated according to a standard method (AATCC Test Method 195-2011) to measure the one way transport index, i.e. R value. According to the standard, R value between 200 and 300 represents very good water transport ability, and the value over 300 indicated excellent directional water transport ability. The test results are listed in Table 1. For the un-treated cotton fabric, the R value was low, measured to be 146. When the fabric was treated with 50% non-wetting pattern, R values jumped to over 500 for both positive and negative patterned fabrics. After further one side e-spraying superhydrophobic coating on the patterned fabric, the R values increased to almost 700 to either positive or negative. This functioned fabric is durable to withstand repeated wash. After 50 washing cycles, the R values had a slight increase, from 779 to 780 for positive patterned fabric, and from 697 to 745 for the negative fabric.

In addition to R value, the test also gave the overall moisture management capability (OMMC) of the fabrics, which were above 0.6 for all the treated samples. According to the standard, an OMMC value between 0.4 and 0.6 suggests very good moisture management capability, and larger OMMC value than 0.6 indicates excellent moisture management capability. As shown in Table 1. After non-wetting pattern treatment, both positive and negative patterned fabrics have OMMC value over 0.6. The treated fabric with non-wetting pattern and directional water transport effect also showed OMMC value over 0.6, and the OMMC value is higher for all the treated fabrics after 50 washing cycles. These results demonstrate that after the coating treatment, all the fabrics showed excellent moisture management capability.

TABLE 1

R and OMMC values of non-wetting pattern and directional water transport effect fabrics.

| Fabric | Pattern style | One way transport capability (R value) | OMMC |
|---|---|---|---|
| Control fabric | — | 146 | 0.57 |
| 50% portion patterned fabric | Positive | 638 | 0.75 |
| | Negative | 532 | 0.60 |
| Patterned fabric with directional water transport effect | Positive | 779 | 0.64 |
| | Negative | 697 | 0.66 |
| After 50 wash cycles | Positive | 780 | 0.69 |
| | Negative | 745 | 0.71 |

The patterned fabric show two-way water transport. It cannot eliminate the wet feel on the inner side, neither stop water wick back from the outer to inner sider, although it also has a high R value.

3.7 Abrasion Test

Figure 6:
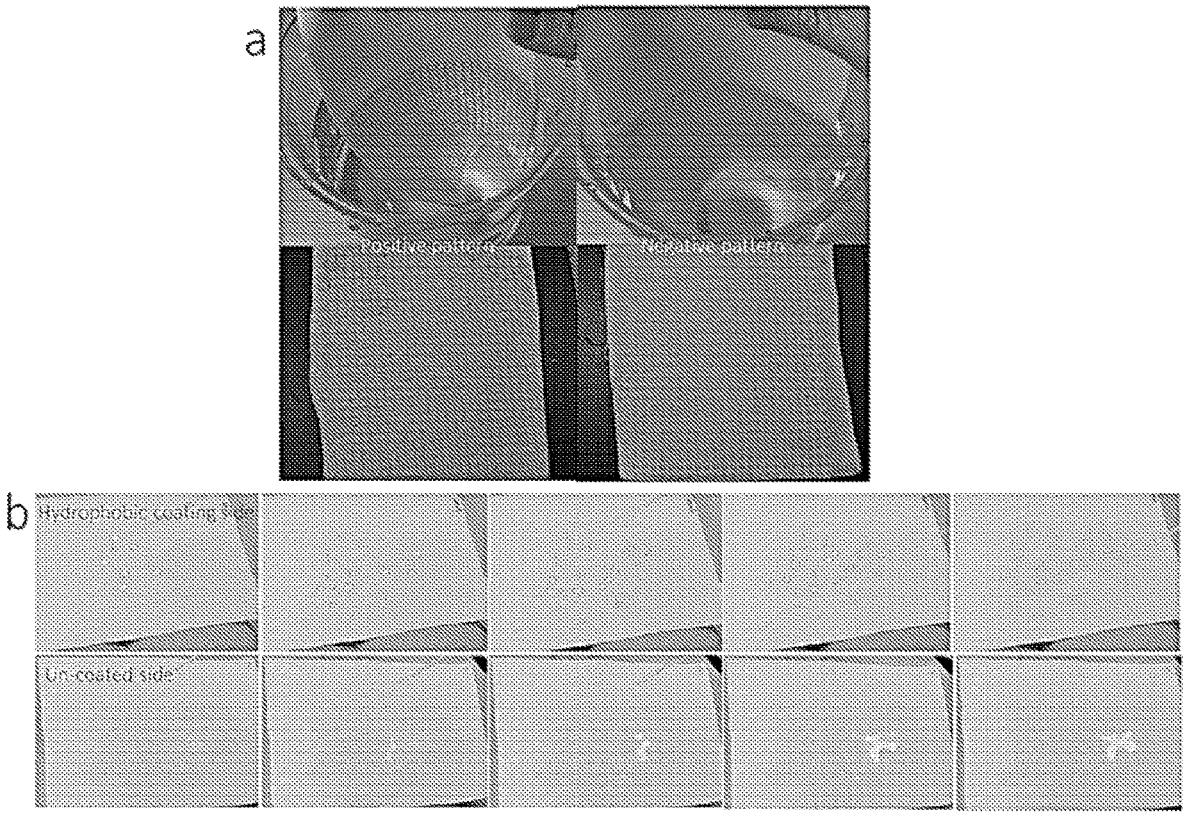
FIG. 6 provides photographs showing a) Positive and negative pattern treated cotton fabric, b) still frames taken from videos showing dropping water on horizontally-laid cotton fabric functioned with pattern treatment and directional water transport effect.

The abrasion durability of the non-wetting patterned and directional water transport functioned fabric was tested by the Martindale method. FIG. 6 shows how the increased abrasion cycles influences the one way transport capability. In the first 3000 abrasion cycles, the R value is almost not change, when the abrasion cycle increased from 3000 to 5000 cycles, the R value had a slight increase, this is because after 3000 abrasion cycles, some fibres on the top surface are broken and removed away, which made the fabric's thickness decreased. As the non-wetting pattern area is throughout the fabric thickness, after abrasion damages, the non-wetting pattern was still stayed on the fabric. As a result, non-wetting patterned fabric with a decreased thickness may have a larger R value.

3.8 Surface Temperature Test

Figure 15:
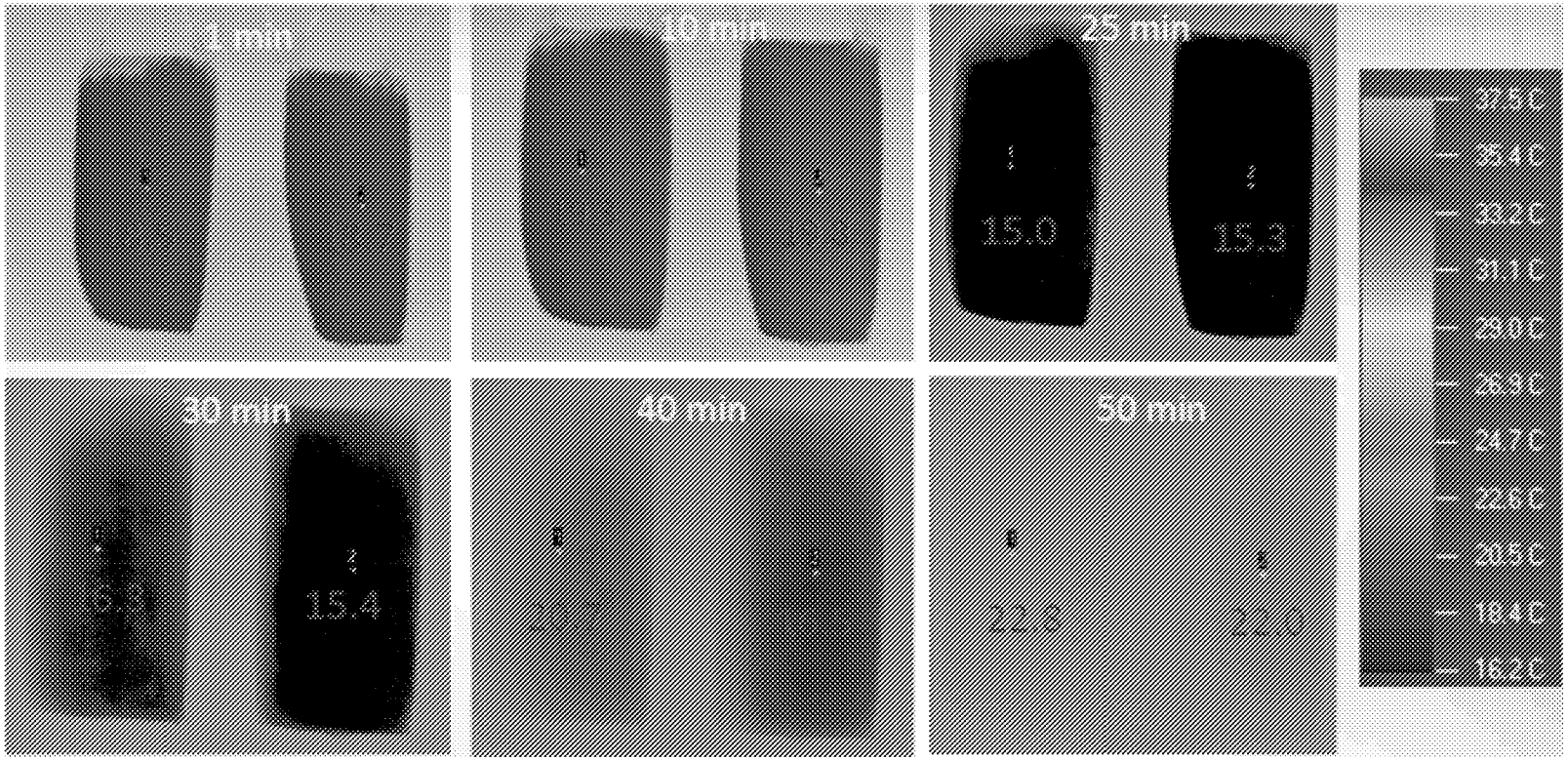
FIG. 15 shows surface temperature change of a treated cotton fabric sample. The left picture in each photo is from the coated side, while the right image from is the uncoated side.

The surface temperature of the non-wetting pattern and directional water transport effect fabric has been measured using an infra image camera. When the fabric contained certain moisture [1~2 mg/cm$^2$], its evaporation from the fabric to the ambient environment caused a temperature difference up to 4° C. between the two fabric surfaces (inner side surface and outer side surface) as shown in FIG. 15.

Figure 5B:
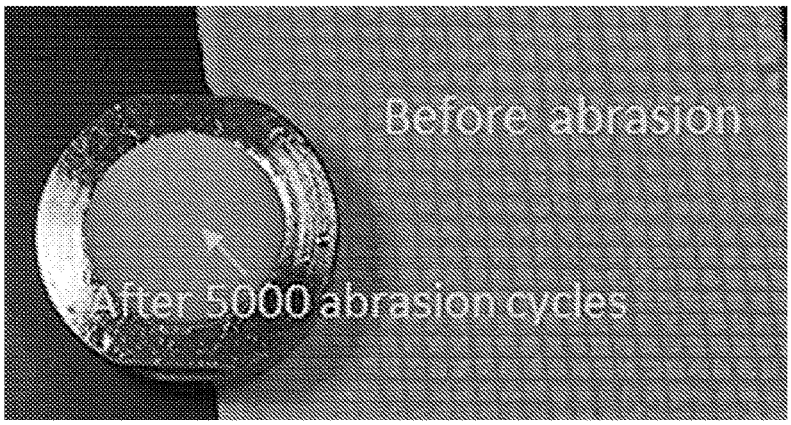
FIG. 5B provides a photograph of a fully wetted non-wetting pattern treated cotton fabric of before and after 5000 abrasion cycles.

3.9 Non-Wetting Pattern and Directional Water Transport Effect Treatment on Different Type Cotton Fabrics Five types of cotton fabrics where used for further characterisation and performance testing of the treatment process of the present invention. These fabrics are Fabric ID No. 1, No. 2, No. 4, No. 5, No. 6 shown in FIG. 5A. The details of the texture structure, fabric thickness of these fabrics are indicated in FIG. 5A. All sample sizes were 10×10 cm×cm.

All the fabrics were treated using the same coating solution and method.

3.9.1 Non-Wetting Pattern Treatment on Different Type Cotton Fabrics (Portion Area is 50%)

The non-wetting of both positive and negative pattern can be also fulfilled on more different type cotton fabrics. After the e-spraying coating treatment, all the fabrics showed clear pattern. When the treated fabrics were immersed in water, some air bubbles were formed on the pattern area, while the hydrophilic un-pattern area was fully wetted by water.

3.9.2 Air Permeability of Different Type Cotton Fabrics Before and after Pattern Treatment Table 2 provides air permeability measurements for the tested fabrics. Again, for the un-treated fabric, there is a big difference of air permeability for the dry and fully-wetted state fabric. After non-wetting pattern treatment (50% portion area), the air permeability for dry fabric decreased, however, for the fully-wetted fabric, the air permeability increased for each of the tested samples when compared to the control. Again, this effect is a result of the patterned area of the treated samples being unable to be wetted.

TABLE 2

Air permeability of different cotton fabrics (cm$^3$/cm$^2$/s)

| Fabric | Control | | Coated | Non-wetting pattern (50%) | | | |
|---|---|---|---|---|---|---|---|
| | | | (100%) | Positive | | Negative | |
| ID | Dry | Wet | — | Dry | Wet | Dry | Wet |
| No. 2 | 21.2 | 0.62 | 25.8 | 24.5 | 13.5 | 25.1 | 12.8 |
| No. 4 | 5.82 | 0.1 | 3.5 | 4.6 | 1.8 | 4.2 | 1.5 |
| No. 5 | 16.2 | 0.3 | 20.2 | 21.1 | 8.7 | 21.4 | 8.1 |
| No. 6 | 63.1 | 3.9 | 55.3 | 60.2 | 39.6 | 60 | 34.8 |

3.9.3 Washing Test

Figure 8:
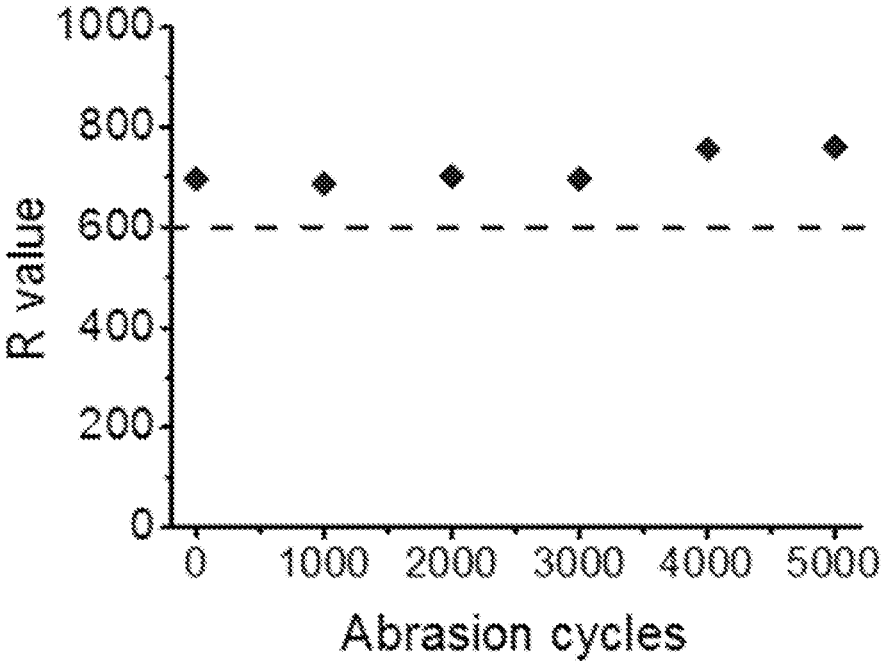
FIG. 8 is a plot demonstrating the effect of abrasion damage on one way transport capability (R value).

Washing durability was tested to all type cotton fabrics with non-wetting pattern. After 50 washing cycles, the pattern can be seen clearly as seen in FIG. 8, indicating the durability of the superhydrophobic coating.

Figure 9:
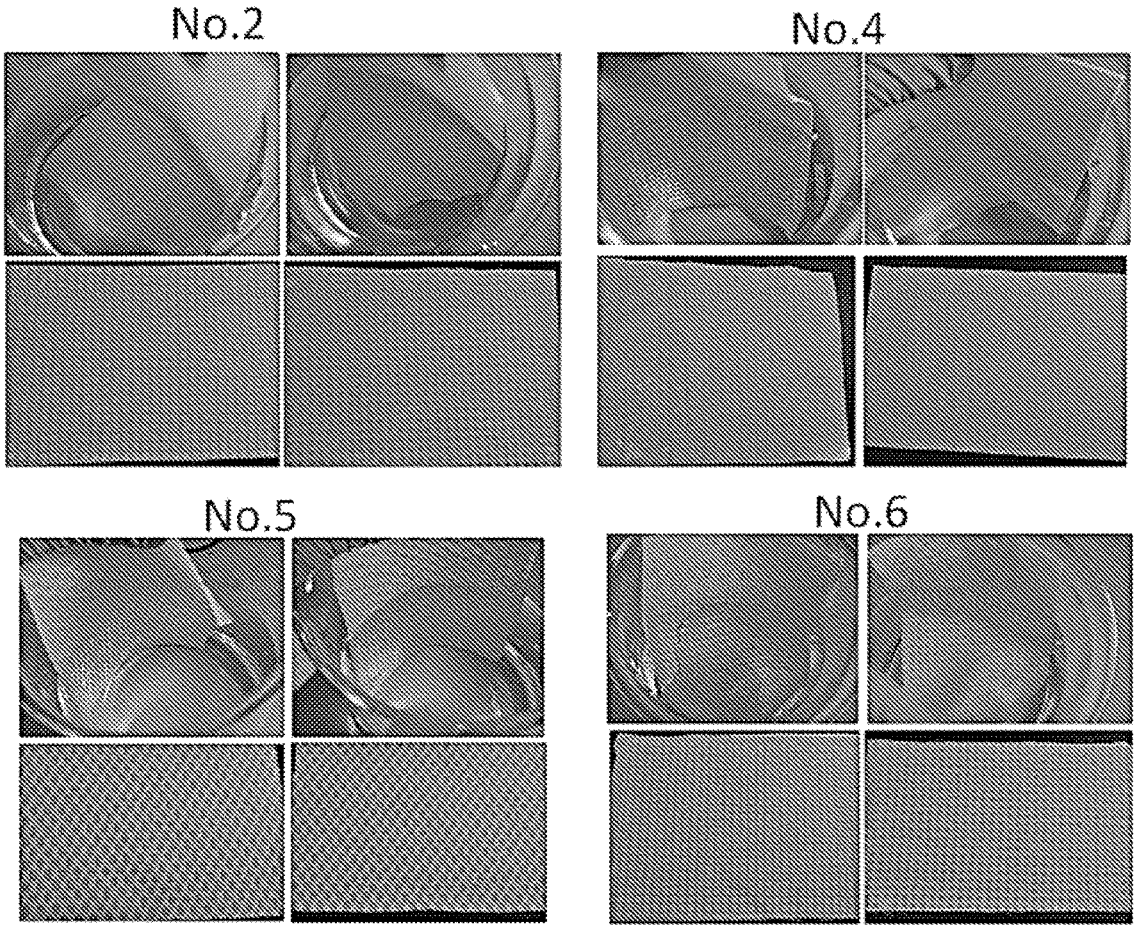
FIG. 9 provides photographs of non-wetting pattern (positive and negative) treatment on different type cotton fabrics.

3.9.4 Directional Water Transport and Non-Wetting Pattern Treated Different Type Fabrics Directional water transport fabrics were prepared using the same coating solution and method. After the coating treatment, all the fabrics showed directional water transport effect. FIG. 9 shows the R values of all types of cotton fabrics before and after coating treatment and after washing tests. For all type cotton fabrics, R vales are below 200 before coating treatment. After 50% non-wetting pattern treatment, all fabrics have R values above 200. Further directional water transport treatment makes all the patterned fabrics have a higher R value of above 400 as shown in FIG. 9. After 50 washing cycles, all the treated fabrics maintained the R values greater than 500, for fabric No. 5, the R values increased from over 400 to over 500. The detailed R values for all the fabrics are listed in Table 3.

TABLE 3

R values for all type cotton fabrics before and after the coating treatments

| Fabric | Pattern | One way transport capability (R) | | | | |
|---|---|---|---|---|---|---|
| ID | style | No. 1 | No. 2 | No. 4 | No. 5 | No. 6 |
| Control | — | 146 | 173 | 52.1 | 146 | 33 |
| 50% patterned | Positive | 638 | 432 | 256 | 267 | 449 |
| fabric | Negative | 532 | 410 | 507 | 342 | 633 |
| DWT + patterned | Positive | 779 | 563 | 629 | 444 | 903 |
| fabrics | Negative | 697 | 733 | 670 | 423 | 945 |
| After 50 wash | Positive | 780 | 656 | 635 | 569 | 886 |
| cycles | Negative | 745 | 689 | 656 | 578 | 940 |

Figure 10:
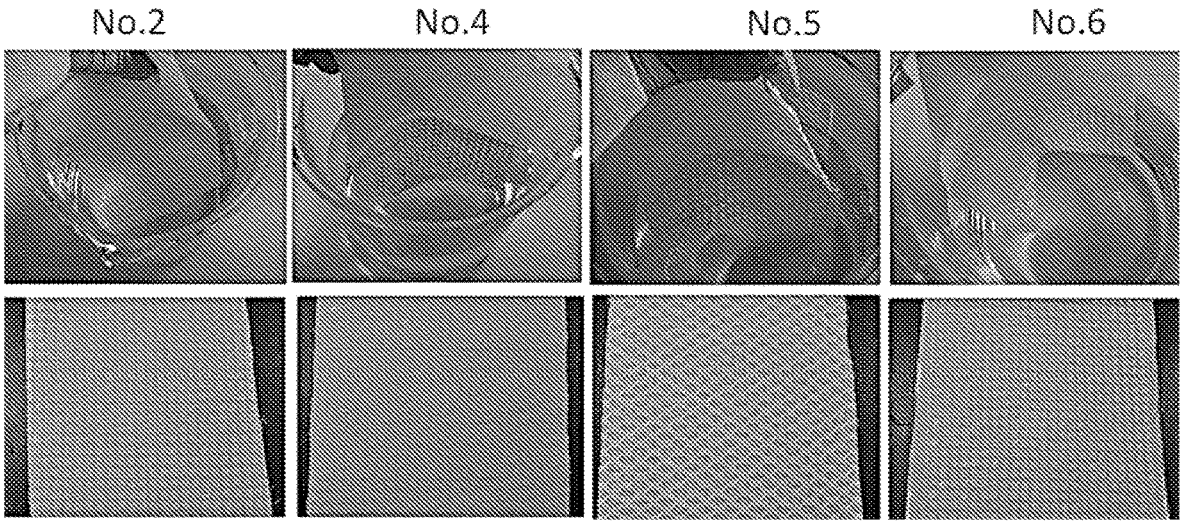
FIG. 10 provides photographs of non-wetting patterned fabrics after 50 cycles of washing tests.
Figure 11:
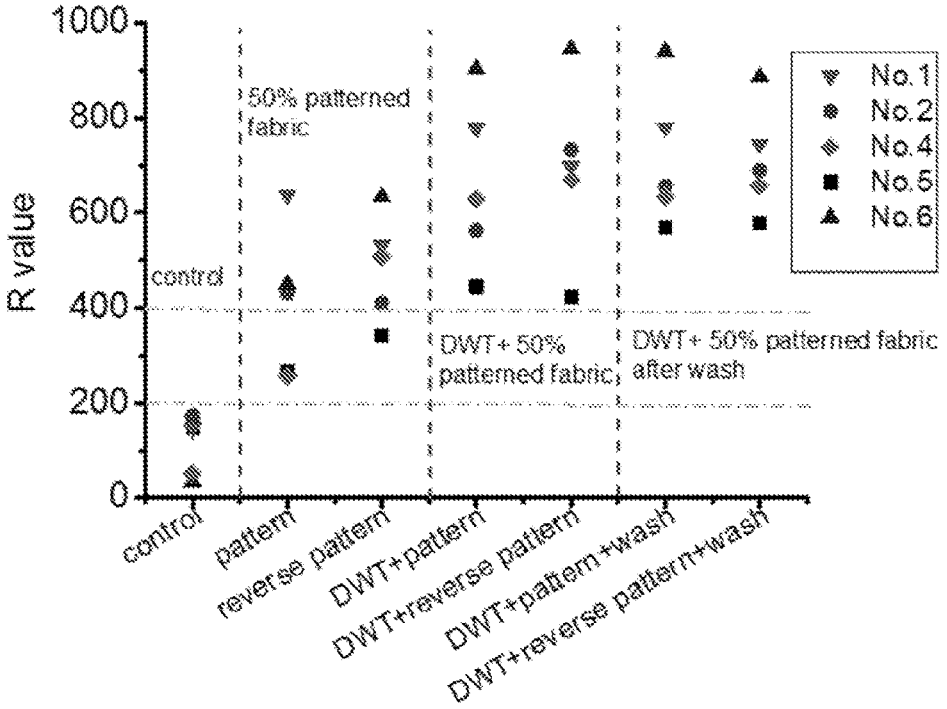
FIG. 11 is a plot demonstrating the one way transport capability (R value) of all type fabrics before and after non-wetting pattern and directional water transport (DWT) treatment.
Figure 12:
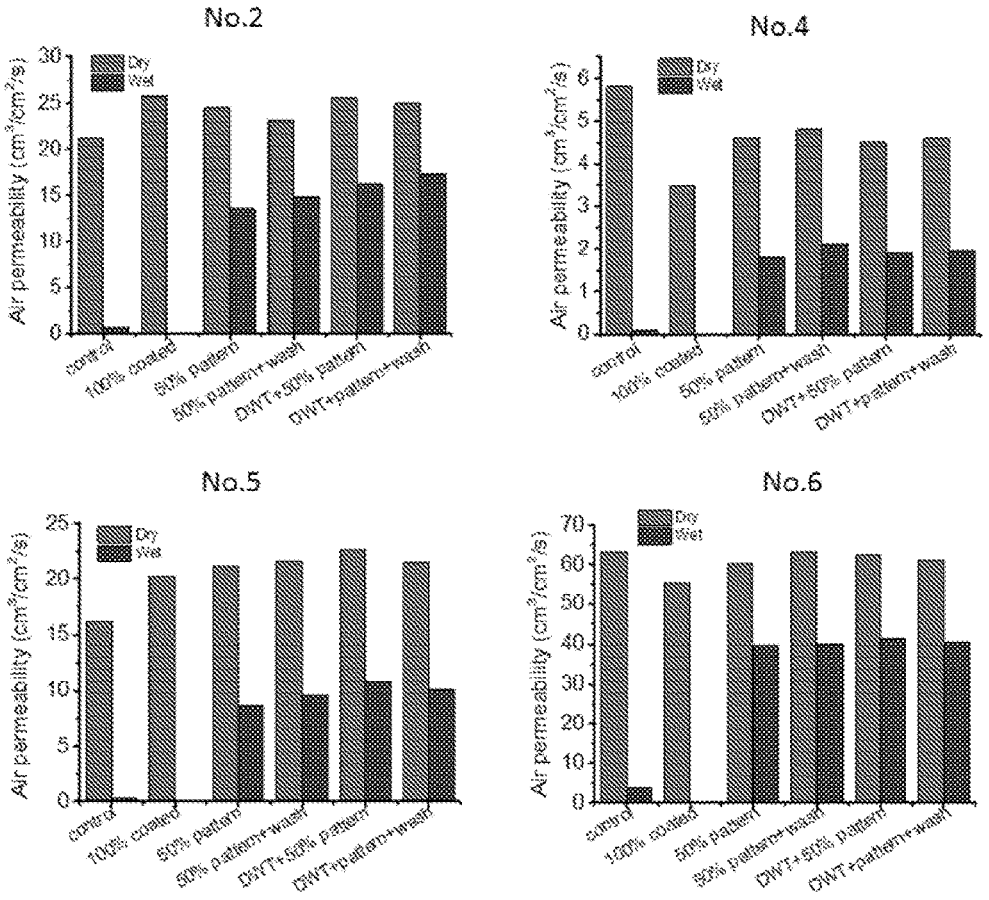
FIG. 12 provides plots demonstrating the air permeability of all type cotton fabrics of before and after non-wetting pattern and directional water transport treatment.

3.9.5 Air Permeability Value to all the Fabrics Before and after the Coating Treatment The fabric samples No. 2, No. 4, No. 5 and No. 6 have very small air permeability in fully-wetted state, 0.62 cm$^3$/cm$^2$/s, 0.1 cm$^3$/cm$^2$/s, 0.3 cm$^3$/cm$^2$/s and 3.9 cm$^3$/cm$^2$/s, respectively, as shown in FIG. 10. After non-wetting pattern treatment, all the fabrics' air permeability had a significant increase of 13.5 cm$^3$/cm$^2$/s, 1.8 cm$^3$/cm$^2$/s, 8.7 cm$^3$/cm$^2$/s and 39.6 cm$^3$/cm$^2$/s, respectively. When further functionalised the patterned fabrics with directional water transport effect, all the fabric samples showed almost no change in air permeability in either dry or fully-wetted state. Furthermore, 50 cycles washing treatment did not influence the air permeability of the treated fabrics.

4. Conclusion

The developed two-step coating of the combination of screen-printing and e-spraying successfully functionalized different type cotton fabrics with non-wetting pattern and directional water transport effect. The treated cotton fabrics were subjected to a series of characterisations, including water contact angle, one way water transport index, air permeability, washing durability. All treated fabrics were found to have directional water transport ability with one way transport index R value over 400 with the highest value as high as over 900 and OMMC value higher than 0.6. The treatment is durable enough to withstand 50 cycles of home laundries and still have an R value higher than 500. The coating treatment has a small influence on air permeability.

Example 2—Product Prototype Coating Treatment with Non-Wetting Pattern and Directional Water Transport (DWT) Effect Fabric product prototypes were developed with the objective of demonstrating the proposed "every-dry", "self-cooling" properties. The fabric product was subjected to a series of characterisations to prove the performance of the fabric. Durability against washing, abrasion and UV irradiation was evaluated.

5.1 Products Selection

Ten cotton products were purchased from commercial stores in Melbourne, Australia (Myers and Target). Table 4 (FIG. 13) shows the details of these cotton products. All the fabrics comprised pure cotton.

Fabric samples taken from these commercial products were used for coating treatment. FIG. 2 provides a schematic of the two stages of the coating procedure. The process follows the steps described above. In brief, the fabric samples were firstly subjected to a patterning treatment to form superhydrophobic patterns on the fabrics. The patterned fabrics were subsequently coated with a superhydrophobic coating on just one side. After treatment, the fabric samples were tested to evaluate the effect on moisture transport ability, air-permeability in both dry and wet states, and washing durability.

5.2 the Coated Cotton Products Showing Both Non-Wetting Pattern and DVVT Effect (50% Positive and Negative Pattern Portion was Applied on Each Sample).

Figure 14:
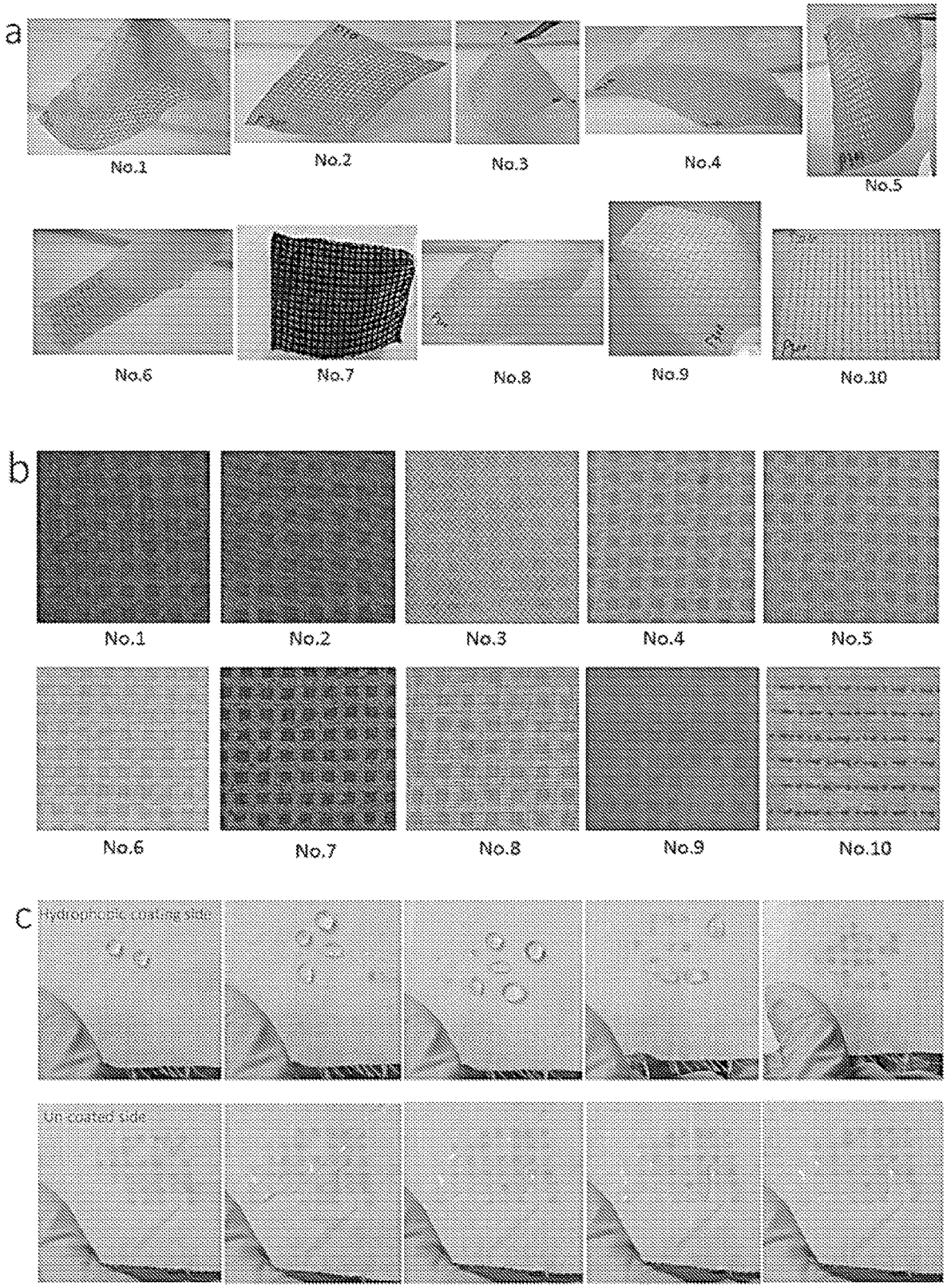
FIG. 14 provides a series of photographs showing Pattern and DWT treated fabric samples wetted by water: a) positive pattern, b) negative pattern. (Pattern area portion is 50%), c) directional water-transport effect (sample No. 8).

In normal state, the treated fabrics have the same appearance to the untreated ones. The patterns cannot be seen unless the fabrics are wetted. FIG. 14(*a, b*) show the photos of the positive and negative treated fabrics wetted in water. The clear areas are un-patterned, and the high transparency comes from the wetting of the fabric with water. However, the patterned areas remain opaque because the superhydrophobicity prevents water from spreading into the local fabric matrix. The unwitting nature of the superhydrophobic patterns enables the fabric to maintain the high air permeability even if it is fully wetted.

FIG. 14*c* shows the directional water-transport effect of the coated fabric No. 8. When dropping water from the hydrophobic coating side, the water penetrated immediately and spread on the other side of the fabric, and left the hydrophobic side still dry. When water was dropped from the hydrophilic side, however, the water spread on the hydrophilic pattern area without transferring to the other side. This result indicated the directional water-transport property of the coated fabrics.

5.3 One-Way Transport Capability

Table 5 lists the accumulative one-way transport capacity index (R) of the treated fabrics measured according to AATCC Test Method 195-2011. All the treated cotton fabrics have an R value at least 250 on the coated side, with the highest value being as high as 860. However, the R value on the uncoated side is negative (−41~−688).

R value is a measure of water transport ability through fabric. A positive R value suggests that water can penetrate easily across the fabric and spread on the opposite side. The higher R value (>200) indicates more water being transported across the fabric, which is more favourable to remove sweat from the body surface and evaporate on the outer layer surface. The negative R value indicates water accumulation on the feeding surface, creating wet feel to the wearer and slowing down moisture evaporation. Therefore, the R value is also a measure of wearing comfort. The higher the R value, the more comfort to wear.

TABLE 4

R value of the treated cotton fabric samples*

| | One way transport capability (R) | | | | |
|---|---|---|---|---|---|
| | | DWT+ pattern | | | |
| | | Positive | | Negative | |
| Fabric ID | Control | Coated side | Un-coated side | Coated side | Un-coated side |
| No. 1 | 15.28 | 755 | −183 | 355 | −256 |
| No. 2 | −300.7 | 730 | −123 | 580 | −340 |
| No. 3 | −102 | 658 | −309 | 341 | −277 |
| No. 4 | −641.9 | 867 | −41 | 495 | −365 |
| No. 5 | 31.74 | 631 | −533 | 263 | −248 |
| No. 6 | −781 | 617 | −110 | 324 | −185 |
| No. 7 | −426 | 525 | −326 | 338 | −376 |
| No. 8 | −70 | 747 | −124 | 696 | −166 |
| No. 9 | −576 | 541 | −74 | 464 | −312 |
| No. 10 | −648 | 852 | −688 | 340 | −426 |

(*Coating system TTC was used for treatment of the cotton fabrics)

For comparison, R value for the untreated fabric is also listed in Table 4. All the untreated fabrics have a negative R value around −648~31 on both sides except for sample No 1 (note: Some commercial products selected have a hydrophobic surface. This hydrophobic coating was removed prior to our experiment).

5.4 Air-Permeability in Dry and Wet State

After patterning and coating treatment, the fabric samples in dry state are slightly reduced in the air-permeability. However, in a fully-wet condition, the treated fabrics show much higher air permeability than the equivalent control samples (see the data in Table 5), confirming that the treatment considerably improves the wet-state permeability of the cotton fabrics. For some fabric samples (e.g. No. 2, 4, 5, 7, 8, 9, 10), the air-permeability in the wet state has small reduction when compared to that in the dry condition.

TABLE 5

Air-permeability of the treated fabric samples in dry and wet states*

| Fabric | Control | | DWT + pattern | | | |
|---|---|---|---|---|---|---|
| | | | Positive | | Negative | |
| ID | Dry | Wet | Dry | Wet | Dry | Wet |
| No. 1 | 20.5 | 4.2 | 18.5 | 7.8 | 19.4 | 8.5 |
| No. 2 | 26.5 | 0.8 | 24 | 18.3 | 27 | 19.5 |
| No. 3 | 39.2 | 2.8 | 34.3 | 24 | 36.8 | 26 |
| No. 4 | 33.5 | 9.5 | 30.2 | 22.8 | 31.3 | 24.2 |
| No. 5 | 60.8 | 13.5 | 47.2 | 33.4 | 45.5 | 35.5 |
| No. 6 | 52.0 | 12.5 | 39.2 | 18.5 | 42.2 | 21.0 |
| No. 7 | 44.5 | 26 | 39.5 | 32.4 | 37.1 | 28 |
| No. 8 | 103 | 72 | 101 | 95 | 104 | 93 |
| No. 9 | 22.5 | 6.5 | 15.2 | 12 | 16.6 | 11.2 |
| No. 10 | 18.5 | 3.6 | 14.6 | 9.0 | 13.5 | 7.8 |

(*Coating system TTC was used for treatment of the cotton fabrics)

5.5 Washing Durability

The washing durability of the functionalized cotton fabrics was studied by reference of standard test method. After 50 cycles of laundry, the R value for all the treated samples is slightly increased, to above 620 (see Table 6). The R value on the uncoated side changes to −79~−$^{+}$688. This result indicates that the fabrics still maintain the excellent one-way moisture management ability after repeated washing.

TABLE 6

Air-permeability of the treated fabric samples in dry and wet states*

| | DWT+ pattern: One way transport capability (R) | | | |
|---|---|---|---|---|
| | Positive | | Negative | |
| Fabric ID | Coated side | Un-coated side | Coated side | Un-coated side |
| No. 1 | 749 | −154 | 259 | −169 |
| No. 2 | 887 | −187 | 742 | −158 |
| No. 3 | 1147 | −310 | 349 | −210 |
| No. 4 | 656 | −85 | 327 | −320 |
| No. 5 | 1033 | −688 | 235 | −146 |
| No. 6 | 627 | −177 | 296 | −122 |
| No. 7 | 652 | −632 | 341 | −265 |
| No. 8 | 1117 | −79 | 669 | −558 |
| No. 9 | 1112 | −103 | 551 | −312 |
| No. 10 | 726 | −359 | 247 | −98 |

(*Coating system TTC was used for treatment of the cotton fabrics)

5.6 "Self-Cooling" Test by Infrared Camera

To prove the "self-cooling" effect, we deliberately wetted a coated fabric sample and then allowed the fabric to dry naturally at ambient environment. By monitoring the surface temperature change with time, we can examine the effect of moisture on fabric surface temperature. FIG. 15 shows the surface temperature change of a wetted fabric sample on the two surfaces. The temperature difference was found to reach 4.2° C., with the uncoated surface lower than the coated one.

During practical applications, the fabric absorbs moisture all the time from the wearer's body surface. This makes the fabric maintain moisture content at certain level. Because of the one-way transport ability, the fabric proactively transfer moisture from the skin to the outer surface (uncoated). As a result, heat energy is taken off because of water evaporation, lowering the fabric temperature and drawing the heat flows outwards, hence creating a nice cool feel to the wearer. The temperature difference of 4° C. can be considered as significant for textile applications.

5.7 Conclusion

In summary, our test on ten commercial cotton products indicated that the coating technology developed can be used to directly functionalize cotton products. After treatment all the fabrics show significantly improved one-way moisture management ability and wet-state air-permeability. The functional coating is also durable enough against at least 50 cycles of repeated washing. This technique should be able to improve the wear comfort of cotton fabric products.

Example 3—Nanofibrous Membrane

Capstone®FS-82 solution was prepared by mixing Capstone®FS-82 (3 g) in 100 ml tap water to form a homogeneous superhydrophobic solution which can be applied onto the hydrophilic substrate to form a non-wetting coating. Hydrophilic PVA nanofibrous membrane was selected as substrate. Two-step coating process was developed to functionalize PVA membrane. In the first step, a Capstone®FS-82 non-wetting pattern (area portion is 50%) was generated on PVA nanofiber membrane using the screen e-spraying method. Capstone®FS-82 non-wetting coating solution was subsequently electrosprayed on one side of the patterned PVA nanofiber membrane. This makes the un-patterned area have a directional water transport effect. The membrane can also be functionalized in the reverse way. After the coating treatment, the PVA membrane was dried at 70° C. 100° C. for 15 minutes. The resulted membrane showed non-wetting pattern with directional water transport effect on the un-patterned area.

One way water transport ability was evaluated according to a standard method (AATCC Test Method 195-2011) to measure the one way transport index, i.e. R value of the treated nanofibrous membrane. After the two-step coating treatment, the R value is larger than 300, which indicated the excellent directional water transport ability.

Example 4—Functionalized Sponge Membranes

Polyvinyl butyral (PVB)/Fluorinated alkyl silane (FAS) solution was prepared by mixing 2 g PVB polymer in ethanol (100 ml) under magnetic stirring to form a homogenous PVB solution, and then 0.5 g FAS was added into the as-prepared PVB solution to form the superhydrophobic PVB/FAS coating solution. A hydrophilic sponge was applied as the coating substrate (thickness is less then 1 μm).

Two-step coating process was developed to functionalized sponge membrane. Firstly, PVB/FAS superhydrophobic pattern (area portion is around 50%) was generated on the sponge membrane using the screen e-spraying method. PVB/FAS superhydrophobic coating solution was then electrosprayed on one side of the patterned sponge membrane. This results the un-patterned area have a directional water transport effect. The membrane can also be functionalized in the reverse way. After the coating treatment, the sponge membrane was dried at 70° C. for 15 minutes. The prepared membrane showed non-wetting pattern and directional water transport effect in the un-patterned area.

The treated sponge membrane showed R value greater than 300, which indicated the excellent directional water transport ability.

Advantages

A garment treated according to the present invention maintains the benefits of evaporative cooling because the liquid moisture is free to spread on the outer side of the garment, where the amount of wetted surface area on the outer side of the garment will be a major influence on evaporation rate. Second, the garment will have lesser tendency to stick to a wearer's skin and restrict movement. Third, the overall absorbent capacity of the garment is much reduced in comparison to 100% untreated cotton by including cotton (and/or other hydrophilic fibres) which has been treated to reduce its absorbent capacity. This reduction in overall absorbent capacity of the garment means that the garment will not become as heavy as a 100% untreated cotton garment as the garment becomes saturated. The reduced weight of the (wet) garment translates into improved performance of the wearer or at least the perception of improved performance as well as a further improvement in the perception of comfort. Fourth, the reduced absorbent capacity of the garment translates into less sagging of the garment. Fifth, the garment will dry faster than 100% untreated cotton. The time required for a wet garment to dry depends on the amount of liquid contained in the garment. As the garment reaches saturation, this amount of liquid is equal to the absorbent capacity of the garment. After exercise or completion of whatever activity causes the perspiration, the body temperature begins to drop back to the resting temperature and because the garment contains less moisture, there will be less evaporative cooling. If the garment is taken off and allowed to air dry or machine dry, it will dry faster and with less energy.

The present invention can produce a cotton fabric with "ever-dry" and "self-cooling" functions, prepared by functional designs and combination of permeable non-wetting channels with directional water-transport function on single layer cotton fabric. "Ever dry" and "self-cooling" represents advanced fabric functions that can considerably enhance the ability of cotton fabrics to regulate moisture transport, breathability and surface temperature.

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. A substrate having a unidirectional water transport property, the substrate having a fluid permeable structure and including:

an inner side surface; and an outer side surface having a higher absorbent capacity than the inner side surface;

wherein the substrate includes:

a plurality of hydrophobic channels and hydrophilic channels which respectively extend between the inner side surface and the outer side surface and are arranged in a pattern across the length and width of the substrate; and a hydrophobic surface layer which extends continuously over the inner side surface of the substrate and over the pattern of plurality of hydrophobic channels and hydrophilic channels, the hydrophobic surface layer having a thickness of less than 150 μm which, in use, produces a substantial hydrophobic property to contacting water, whilst allowing for water contacting the inner side surface of the substrate to wick through the hydrophobic surface layer into the substrate.

2. A substrate according to claim 1, wherein at least one of the hydrophobic channels or the hydrophobic surface layer comprise superhydrophobic channels.

3. A substrate according to claim 1, wherein the hydrophobic surface layer has a thickness of between 20 to 100 μm.

4. A substrate according to claim 1, wherein the inner side of the substrate has an accumulative one-way transport capacity index (R) (measured by AATCC Test Method 195-2011) of at least 200.

5. A substrate according to claim 1, wherein the hydrophobic channels are respectively interspaced by the hydrophilic channels.

6. A substrate according to claim 1, wherein the hydrophobic channels are arranged in a regular repeating pattern, along the length and width of the substrate.

7. A substrate according to claim 1, wherein the hydrophobic channels are arranged in a regular array of spaced apart sections across the length and width of the substrate.

8. A substrate according to claim 1, wherein the hydrophobic channels form columns between the inner side surface and the outer side surface which are surrounded by the hydrophilic channels.

9. A substrate according to claim 6, wherein the hydrophobic channels are arranged in a pattern which occupy between 30 to 70% of the total surface area of the lateral plane of the pattern.

10. A substrate according to claim 1, wherein the hydrophobic surface layer and surfaces in the hydrophobic channels have a water contact angle greater than 150 degrees.

11. A substrate according to claim 1, wherein the surface temperature difference between the inner side surface and outer side surface of a wetted substrate is at least 2° C. during moisture evaporation from the substrate.

* * * * *